US011986707B2

(12) United States Patent
Griffin et al.

(10) Patent No.: US 11,986,707 B2
(45) Date of Patent: May 21, 2024

(54) FACEPLATE OF A GOLF CLUB HEAD

(71) Applicant: Wilson Sporting Goods Co., Chicago, IL (US)

(72) Inventors: Sean P. Griffin, Chicago, IL (US); Ninad Trifale, Chicago, IL (US); Richard P. Hulock, North Aurora, IL (US); Jon C. Pergande, Chicago, IL (US); Robert T. Thurman, Glen Ellyn, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 238 days.

(21) Appl. No.: 17/408,091

(22) Filed: Aug. 20, 2021

(65) Prior Publication Data

US 2022/0054902 A1 Feb. 24, 2022

Related U.S. Application Data

(60) Provisional application No. 63/068,889, filed on Aug. 21, 2020.

(51) Int. Cl.
*A63B 53/04* (2015.01)

(52) U.S. Cl.
CPC ..... *A63B 53/0458* (2020.08); *A63B 53/0425* (2020.08); *A63B 53/0429* (2020.08); *A63B 53/0466* (2013.01); *A63B 2209/02* (2013.01)

(58) Field of Classification Search
CPC ..... A63B 53/0416; A63B 53/0458; A63B 53/0462
USPC ..... 473/324–350
See application file for complete search history.

(56) References Cited

U.S. PATENT DOCUMENTS

| | | | | |
|---|---|---|---|---|
| 5,344,140 | A * | 9/1994 | Anderson | A63B 60/00 473/342 |
| 5,377,986 | A | 1/1995 | Viollaz et al. | |
| 5,425,538 | A | 6/1995 | Vincent et al. | |
| 5,830,084 | A * | 11/1998 | Kosmatka | A63B 69/3635 473/324 |
| 5,971,868 | A * | 10/1999 | Kosmatka | A63B 69/3635 473/324 |
| 6,435,980 | B1 | 8/2002 | Reyes et al. | |
| 6,478,693 | B2 * | 11/2002 | Matsunaga | A63B 53/0466 473/345 |
| 6,508,722 | B1 * | 1/2003 | McCabe | A63B 53/04 473/345 |
| 6,582,323 | B2 | 6/2003 | Soracco et al. | |

(Continued)

FOREIGN PATENT DOCUMENTS

| | | | | |
|---|---|---|---|---|
| CA | 2218837 | A1 * | 4/1998 | |
| CN | 1188018 | A * | 7/1998 | A63B 53/04 |

(Continued)

*Primary Examiner* — Alvin A Hunter
(74) *Attorney, Agent, or Firm* — Terence P. O'Brien; Todd A. Rathe

(57) ABSTRACT

A golf club may include a head having a body and a faceplate coupled to the body. The faceplate may have a maximum thickness at a central location and a cross-section intersecting the central location. The cross-section may have continuously variable wall thickness across the faceplate. The faceplate may have a closed non-convex contour curve defined by constant faceplate wall thickness that encloses the central location.

24 Claims, 25 Drawing Sheets

(56) References Cited

U.S. PATENT DOCUMENTS 6,602,150 B1 * 8/2003 Kosmatka ..... A63B 53/0466 473/332
6,652,391 B1 * 11/2003 Kubica ..... A63B 53/02 473/345
6,679,786 B2 * 1/2004 McCabe ..... A63B 53/0466 473/305
6,863,626 B2 3/2005 Evans et al.
6,902,497 B2 6/2005 Deshmukh et al.
6,904,663 B2 6/2005 Willett et al.
6,986,715 B2 1/2006 Mahaffey
6,997,820 B2 2/2006 Willett et al.
7,014,570 B2 3/2006 Evans et al.
7,018,303 B2 * 3/2006 Yamamoto ..... A63B 60/52 473/329
7,018,305 B2 * 3/2006 Sugimoto ..... A63B 53/04 473/345
7,101,289 B2 9/2006 Gibbs et al.
7,137,907 B2 11/2006 Gibbs et al.
7,140,975 B2 11/2006 Bissonnette et al.
7,144,337 B2 * 12/2006 Hirano ..... A63B 53/047 473/329
7,258,626 B2 8/2007 Gibbs et al.
7,267,620 B2 9/2007 Chao et al.
7,314,418 B2 1/2008 Galloway et al.
7,318,781 B2 1/2008 Deshmukh
7,338,388 B2 4/2008 Schweigert et al.
7,422,528 B2 9/2008 Gibbs et al.
7,448,960 B2 11/2008 Gibbs et al.
7,527,565 B1 5/2009 Ehlers et al.
7,549,934 B2 * 6/2009 Rice ..... A63B 60/00 473/345
7,628,712 B2 12/2009 Chao et al.
7,645,201 B2 1/2010 Ehlers et al.
7,651,412 B2 1/2010 Meyer et al.
7,713,140 B2 5/2010 Gibbs et al.
7,850,546 B2 12/2010 Chao et al.
7,862,452 B2 1/2011 Chao et al.
7,871,340 B2 1/2011 Chao et al.
7,874,936 B2 1/2011 Chao
7,874,938 B2 1/2011 Chao
7,878,922 B2 2/2011 Ehlers et al.
7,938,742 B2 5/2011 Galloway et al.
7,967,700 B2 6/2011 Stites
7,985,146 B2 7/2011 Lin et al.
8,007,372 B2 8/2011 Long et al.
8,012,041 B2 9/2011 Gibbs et al.
8,016,691 B2 9/2011 Stites
8,021,245 B2 9/2011 Beach
8,025,590 B2 9/2011 Rice et al.
8,038,544 B2 * 10/2011 Meyer ..... A63B 53/0466 473/332
8,047,930 B2 11/2011 Rice et al.
8,070,623 B2 12/2011 Stites et al.
8,083,612 B2 12/2011 Stites et al.
8,096,897 B2 1/2012 Beach et al.
8,128,509 B2 3/2012 Soracco et al.
8,163,119 B2 4/2012 Chao
8,210,965 B2 7/2012 Roach et al.
8,221,261 B2 7/2012 Curtis et al.
8,226,498 B2 7/2012 Stites et al.
8,262,502 B2 9/2012 Rice et al.
8,272,975 B2 9/2012 Morin et al.
8,303,435 B2 11/2012 Chao
8,337,329 B2 * 12/2012 Wada ..... A63B 53/0466 473/345
8,342,982 B2 1/2013 Clausen et al.
8,376,873 B2 2/2013 Golden et al.
8,376,876 B2 2/2013 Gibbs et al.
8,409,032 B2 4/2013 Myrhum et al.
8,439,769 B2 * 5/2013 Rice ..... A63B 60/00 473/345
8,449,407 B2 5/2013 Rice et al.
8,454,453 B2 6/2013 Hettinger et al.
8,480,512 B2 7/2013 Oldknow et al.
8,480,514 B2 7/2013 Hartwell et al.
8,485,918 B2 7/2013 Roach
8,496,542 B2 7/2013 Curtis et al.
8,517,859 B2 8/2013 Golden et al.
8,535,177 B1 * 9/2013 Wahl ..... A63B 53/04 D21/748
8,562,458 B2 10/2013 Morin et al.
8,608,585 B2 12/2013 Stites et al.
8,628,434 B2 1/2014 Chao
8,657,701 B2 2/2014 Boyd et al.
8,663,027 B2 3/2014 Morales et al.
8,684,864 B2 4/2014 Lin et al.
8,696,489 B2 4/2014 Gibbs et al.
8,708,837 B2 4/2014 Roach et al.
8,727,908 B2 * 5/2014 Goto ..... A63B 53/04 473/329
8,753,228 B2 6/2014 Golden et al.
8,758,161 B2 6/2014 Golden et al.
8,777,776 B2 7/2014 Wahl et al.
8,784,233 B2 7/2014 Morin et al.
8,826,512 B2 9/2014 Schweigert
8,827,826 B2 9/2014 Stites et al.
8,864,602 B2 10/2014 Curtis et al.
8,876,629 B2 11/2014 Deshmukh et al.
8,894,508 B2 11/2014 Myrhum et al.
8,956,246 B2 2/2015 Myrhum et al.
8,956,247 B2 2/2015 Morin et al.
8,979,669 B2 3/2015 Greaney et al.
8,979,672 B2 * 3/2015 Samson ..... A63B 60/00 473/329
9,033,818 B2 5/2015 Myrhum et al.
9,033,819 B2 5/2015 Wahl et al.
9,101,809 B2 8/2015 Gibbs et al.
9,138,621 B2 9/2015 Roach et al.
9,174,099 B2 11/2015 Greaney et al.
9,192,826 B2 11/2015 Golden et al.
9,199,137 B2 12/2015 Deshmukh et al.
9,216,327 B2 12/2015 Morin et al.
9,238,448 B2 3/2016 Sander
9,283,447 B1 3/2016 DeMille et al.
9,283,449 B1 3/2016 DeMille et al.
9,370,697 B2 6/2016 Beno et al.
9,370,698 B2 6/2016 Deshmukh et al.
9,409,065 B2 8/2016 Morales et al.
9,409,066 B2 8/2016 Lin et al.
9,433,835 B2 9/2016 Sugimae et al.
9,474,945 B2 10/2016 Fossum
9,539,476 B2 1/2017 Schweigert
9,566,481 B2 2/2017 Morin et al.
9,579,548 B2 2/2017 Boyd et al.
9,636,555 B2 5/2017 Stites et al.
9,682,289 B2 6/2017 Golden et al.
9,682,291 B2 6/2017 Chao
9,683,301 B2 6/2017 Wahl et al.
9,687,699 B2 6/2017 Cole et al.
9,700,766 B2 7/2017 Sugimae et al.
9,717,960 B2 8/2017 Deshmukh et al.
9,724,575 B2 8/2017 Morin et al.
9,833,670 B2 12/2017 Fossum
9,878,217 B2 1/2018 Morales et al.
9,889,347 B2 2/2018 Morales et al.
9,889,351 B2 2/2018 Slaughter et al.
9,993,699 B2 6/2018 Larson
9,993,704 B2 6/2018 Hebreo et al.
9,999,811 B2 6/2018 Boyd et al.
10,065,088 B2 9/2018 Hebreo et al.
10,080,935 B2 9/2018 Boyd et al.
10,080,936 B2 9/2018 Sander
10,086,238 B1 10/2018 Roach et al.
10,143,898 B2 12/2018 Cornelius et al.
10,173,106 B2 1/2019 Slaughter et al.
10,179,268 B2 1/2019 Fossum
10,183,201 B2 1/2019 Schweigert
10,220,268 B2 5/2019 Golden et al.
10,307,648 B2 6/2019 Boyd et al.
10,322,320 B2 6/2019 Morales et al.
10,335,644 B2 7/2019 Cole et al.
10,335,646 B2 7/2019 Morales et al.
10,335,659 B2 7/2019 Motokawa et al.

(56) References Cited

U.S. PATENT DOCUMENTS

| | | | | |
|---|---|---|---|---|
| 10,343,034 | B2 | 7/2019 | Henrikson et al. | |
| 10,343,037 | B2 | 7/2019 | Hebreo et al. | |
| 10,350,468 | B2 | 7/2019 | Hebreo et al. | |
| 10,406,408 | B1 | 9/2019 | Seluga et al. | |
| 10,420,992 | B2 | 9/2019 | Stites et al. | |
| 10,478,687 | B2 | 11/2019 | Larson | |
| 10,507,366 | B2 | 12/2019 | Hebreo et al. | |
| 10,512,825 | B1 | 12/2019 | Roach et al. | |
| 10,518,150 | B2 | 12/2019 | Fossum | |
| 10,518,151 | B2 | 12/2019 | Blevins et al. | |
| 10,589,155 | B2 | 3/2020 | Hoffman et al. | |
| 10,596,423 | B2 | 3/2020 | Henrickson et al. | |
| 10,610,748 | B2 | 4/2020 | Hoffman et al. | |
| 10,625,126 | B2 | 4/2020 | Demkowski et al. | |
| 10,632,350 | B2 | 4/2020 | Beach et al. | |
| 10,675,517 | B2 | 6/2020 | Spackman et al. | |
| 10,758,789 | B2 * | 9/2020 | Bacon | A63B 53/0466 |
| 11,179,613 | B2 | 11/2021 | Blevins et al. | |
| 11,207,573 | B2 | 12/2021 | Cleghorn et al. | |
| 11,253,756 | B2 | 2/2022 | Hoffman et al. | |
| 11,318,358 | B1 | 5/2022 | Story et al. | |
| 11,351,429 | B2 | 6/2022 | Halberg et al. | |
| 1,140,344 | A1 | 9/2022 | Seluga | |
| 2003/0013542 | A1 * | 1/2003 | Burnett | A63B 60/00 473/345 |
| 2003/0064823 | A1 * | 4/2003 | Yamamoto | A63B 53/04 473/345 |
| 2004/0099538 | A1 * | 5/2004 | Chao | B23H 9/00 205/705 |
| 2004/0180731 | A1 * | 9/2004 | Tseng | A63B 53/0466 473/345 |
| 2004/0235585 | A1 * | 11/2004 | Sanchez | A63B 53/04 473/346 |
| 2005/0003901 | A1 * | 1/2005 | Kuroda | C22C 14/00 473/324 |
| 2005/0009631 | A1 * | 1/2005 | Krumme | A63B 53/047 473/342 |
| 2005/0009634 | A1 * | 1/2005 | Rice | A63B 53/0466 473/345 |
| 2005/0101407 | A1 * | 5/2005 | Hirano | A63B 60/00 473/342 |
| 2006/0194644 | A1 * | 8/2006 | Nishio | A63B 53/0466 473/345 |
| 2008/0096689 | A1 * | 4/2008 | Oyama | A63B 53/0466 473/349 |
| 2009/0163296 | A1 * | 6/2009 | Chao | A63B 53/0466 264/258 |
| 2010/0197425 | A1 * | 8/2010 | Clausen | A63B 53/04 473/346 |
| 2011/0319190 | A1 * | 12/2011 | Wada | A63B 53/0466 473/349 |
| 2012/0214608 | A1 * | 8/2012 | Guchinskiy | A63B 69/3623 473/236 |
| 2014/0213387 | A1 * | 7/2014 | Samson | A63B 60/00 473/345 |
| 2015/0165280 | A1 * | 6/2015 | Hebreo | A63B 60/00 473/342 |
| 2017/0007892 | A1 * | 1/2017 | Schweigert | A63B 53/04 |
| 2019/0046845 | A1 * | 2/2019 | Greensmith | B22D 13/04 |
| 2019/0192927 | A1 * | 6/2019 | Bacon | A63B 60/00 |
| 2020/0129824 | A1 | 4/2020 | Blevins et al. | |
| 2020/0282270 | A1 * | 9/2020 | James | A63B 53/0466 |
| 2021/0113896 | A1 | 4/2021 | Greensmith et al. | |
| 2021/0362012 | A1 * | 11/2021 | Simone | A63B 53/0408 |
| 2022/0080273 | A1 | 3/2022 | Blevins et al. | |
| 2022/0184466 | A1 | 6/2022 | Greensmith et al. | |
| 2022/0184468 | A1 | 6/2022 | Greaney et al. | |

FOREIGN PATENT DOCUMENTS

| | | | | | |
|---|---|---|---|---|---|
| CN | 102895766 | A | * | 1/2013 | A63B 53/04 |
| JP | 09192270 | A | * | 7/1997 | A63B 53/0466 |
| JP | 09192273 | A | * | 7/1997 | A63B 53/0466 |
| JP | 2004358225 | A | * | 12/2004 | A63B 53/0466 |
| JP | 2006230772 | A | * | 9/2006 | A63B 53/0466 |
| JP | 2008099903 | A | * | 5/2008 | A63B 53/0466 |
| JP | 2012005679 | A | * | 1/2012 | A63B 53/0466 |
| JP | 2016013419 | A | * | 1/2016 | A63B 53/04 |
| WO | WO-0200306 | A1 | * | 1/2002 | A63B 53/02 |

* cited by examiner

| 9 DEGREE S-FLEX TESTING | CLUB SPEED | BALL SPEED | LAUNCH ANGLE | SPIN RATE | HEIGHT | CARRY DISTANCE | TOTAL DISTANCE |
|---|---|---|---|---|---|---|---|
| WILSON D9 | 96.8 | 141.4 | 13.9 | 2593 | 26.1 | 220.0 | 250.3 |
| CALLAWAY MAVRIK | 96.4 | 142.4 | 13.0 | 2514 | 24.5 | 220.0 | 252.0 |
| TAYLOR MADE SIMS | 96.6 | 140.7 | 12.7 | 2745 | 23.7 | 217.2 | 248.0 |
| PING G410 | 98.8 | 140.1 | 13.8 | 3094 | 28.2 | 221.1 | 246.0 |

FIG. 20

| 9 DEGREE R-FLEX TESTING | CLUB SPEED | BALL SPEED | LAUNCH ANGLE | SPIN RATE | CARRY DI STANCE | TOTAL DISTANCE |
|---|---|---|---|---|---|---|
| WILSON D9 | 86.8 | 124.9 | 12.8 | 2817.9 | 176.7 | 212.0 |
| CALLAWAY MAVRIK | 85.9 | 124.9 | 12.3 | 3006.2 | 177.3 | 210.9 |
| TAYLOR MADE SIMS | 86.7 | 125.3 | 12.7 | 3166.8 | 178.0 | 211.7 |

FIG. 21

FACEPLATE OF A GOLF CLUB HEAD

CROSS-REFERENCE TO RELATED PATENT APPLICATIONS

The present application a nonprovisional application claiming priority from U.S. Provisional Patent Application Ser. No. 63/068,889 filed on Aug. 21, 2020, by Griffin et al. and entitled FACE OF A GOLF CLUB HEAD, the full disclosure of which is hereby incorporated by reference. The present application is related to co-pending U.S. patent application Ser. No. 17/408,165 filed on the same day herewith, the full disclosure of which is hereby incorporated by reference.

FIELD OF THE INVENTION

The present invention relates generally to a face of a golf club head for a golf club.

BRIEF DESCRIPTION OF THE DRAWINGS

FIGS. 20 and 21 are graphs of golf club performance testing data of a golf club head, built in accordance with an implementation of the present invention, and other commercially available golf club heads.

DETAILED DESCRIPTION OF THE EXAMPLE EMBODIMENTS

Figure 1:
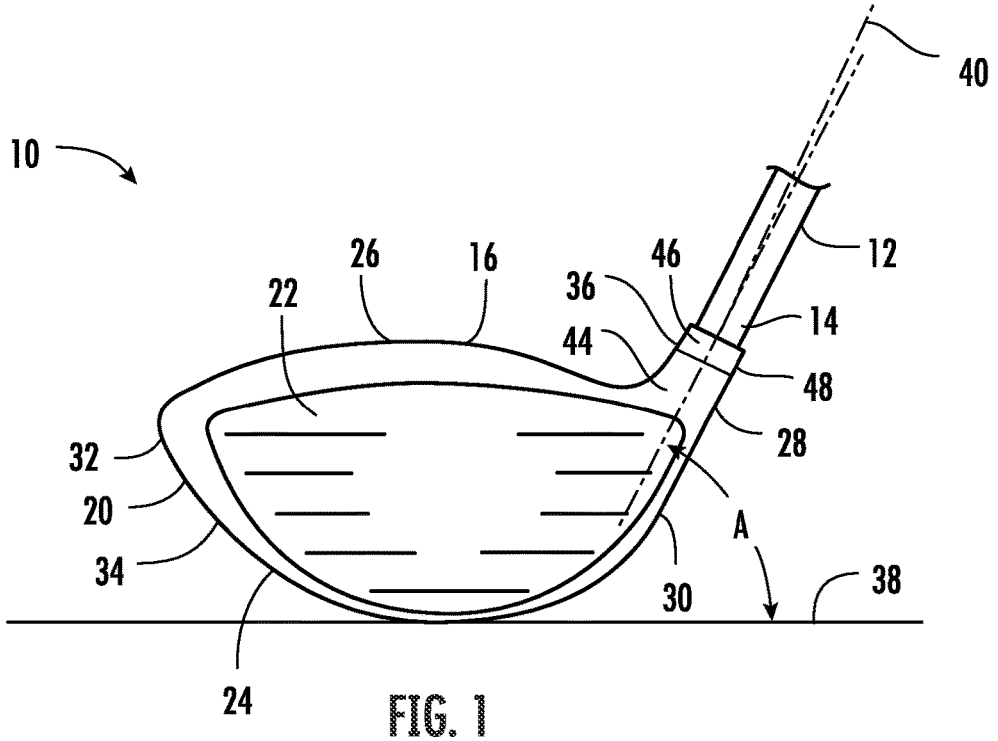
FIG. 1 is a front perspective view of a golf club with the club head on a ground plane in a square face address position in accordance with one example implementation.

Disclosed are example golf clubs having heads having faceplates with example varying thickness profiles that provide enhanced performance. The example faceplates may provide enhanced distance, sound, and performance in a lightweight construction catered to players seeking increased club speed, distance, control and/or performance. In some implementations, the example golf clubs have heads with faceplates that have a continuously variable wall thickness across the faceplate when viewed from a cross-section of the faceplate that extends through a central location of the faceplate. This continuously variable wall thickness may have a maximum thickness at the central location. The example faceplate may have a cross-section or thickness profile that forms a closed non-convex contour curve defined by a constant faceplate wall thickness. The closed non-convex contour curve encloses the central location.

In some implementations, the central location refers to a center point of the striking face of the golf club head. In some implementations, the central location refers to the location on the striking face of the golf club having the largest characteristic time. The "characteristic time", CT, refers to the duration of time during which the struck golf ball resides in contact with a particular point on the surface of the striking face of the golf club. The CT is directly related to the flexibility of the golf club head. The CT value of a golf club head can be determined using United States Golf Association Procedure, USGA-TPX3004, Procedure for Measuring the Flexibility of a Golf Clubhead. In some implementations, the central location refers to the "high impact location" of the striking face of the golf club, the location on the golf club that is a sweet spot or desired hitting location of the strike face of the golf club. In some implementations, the high impact location is a location on the striking face that also has the largest CT. In the examples, the central location also has a maximum thickness.

In the disclosed examples, the closed non-convex contour curve is defined by constant faceplate wall thickness. The closed non-convex contour curve is similar to a topographic curve or isoline, defining a closed loop line of infinitesimal points or locations along which the wall thickness is constant. In some implementations, the "non-convex" nature of the closed contour curve may be similar to that of a concave polygon. In some implementations, the non-convex nature of the closed contour curve may be similar to a concave polygon or non-convex polygon except that the closed loop is formed by smooth curves rather than discrete interconnected line segments. In some implementations, the closed non-convex contour curve may be formed from both straight- or linear-line segments and smooth curves. The closed non-convex curve may have a concave portion or indentation such that a line segment may pass through the indentation, outside of the closed curve while its endpoints lie within the closed curve.

In some implementations, the cross-section faceplate may have a thickness profile that forms multiple closed non-convex contour curves. The multiple closed non-convex curves may be spaced from one another without overlapping one another. In yet other examples, the multiple closed non-convex curves may enclose one another, wherein the multiple closed non-convex curves are each defined by different constant wall thicknesses that have a difference in thickness of at least 0.2 mm. In some examples, the faceplate may include 3 or 4 inter-nested closed non-convex contour curves, wherein each of the closed non-convex contour curves are defined by different constant wall thicknesses that differ from one another by at least 0.2 mm. In some implementations, the faceplate may include a combination of non-convex contour curves formed from concave polygon and concave closed smooth curve loops inter-nested relative to one another or centered about different locations (non-overlapping or non-nesting).

In some implementations, the faceplate has no area of constant wall thickness greater than 1 $mm^2$. In some implementations, the faceplate omits any closed convex contour curves defined by constant faceplate wall thickness within an area of the faceplate that extends radially within the range of 2 mm to 15 mm from the central location. In other implementations, the faceplate omits any closed convex contour curves defined by constant faceplate wall thickness within an area of the faceplate that extends radially within the range of 2 mm to 20 mm from the central location. In other words, no closed convex contour curve defined by infinitesimal points of constant faceplate wall thickness can be found or identified within the region or area of the faceplate that surrounds or encloses the central point and extends radially from 2 mm to 13 mm from the central point. In other implementations, no closed convex contour curve defined by infinitesimal points of constant faceplate wall thickness can be found or identified within the region or area of the faceplate that surrounds or encloses the central point and extends radially from 2 mm to 10 mm from the central point. In such implementations, the faceplate is devoid of any closed convex contour curves defined by infinitesimal points of constant faceplate wall thickness within an area or region of the faceplate extending radially from 2 mm to 20 mm, or 2 mm to 13 mm, from the center point of the faceplate.

In some implementations, the faceplate of the golf club head may have a cross-section through a central location, the cross-section of the faceplate having a wall thickness that undergoes a non-constant rate of change of slope through the central location and/or across the striking face, or faceplate, of the golf club head. In other words, the faceplate of the golf club head when viewed from a cross-section extending through the central location, can have a continuously variable wall thickness across the faceplate (from one interior edge of the faceplate of the cross-section to an opposite interior edge of the faceplate of the cross-section of the faceplate). The term continuously variable wall thickness refers to a cross-section of the faceplate that extends through a central location of the faceplate and where the wall thickness defines an inner surface having a non-constant rate of change of slope. In some implementations, this cross-section is horizontal with respect to a ground plane. In some implementations, this cross-section is vertical with respect to the ground plane. In some implementations, the cross-section is at an angle of 30° with respect to the ground plane. In some implementations, this cross-section is at an angle of 60° with respect to the ground plane. In some implementations, each of multiple cross-sections may have a thickness that undergoes a non-constant rate of change through the central location or cross the striking face (or faceplate) of the golf club head. For example, in some implementations the faceplate may include six of such cross-sections: (1) a first cross-section that is horizontal with respect to the ground plane; (2) a second cross-section that is vertical with respect to the ground plane, (3) a third cross-section that is in an angle of 30° with respect to the ground plane; (4) a fourth cross-section that is at an angle of 60° with respect to the ground plane (5) a fifth cross-section that is at an angle of 60° with respect to the vertical cross-section; and (6) a sixth cross-section that is at an angle of 30° with respect to the vertical cross-section, wherein each of the cross-sections has a thickness that undergoes a non-constant rate of change through the central location.

Disclosed are example methods for forming the above-described faceplates for golf club heads. In addition to forming the example faceplate constructions disclosed, the example methods may be used to form other faceplate configurations as well. The example methods may be based upon iterative, generative dynamic analysis of various thickness data points, wherein ball exit speeds are calculated from simulated impacts at such data points or impact locations.

Disclosed an example golf club that may include a head having a body and a faceplate coupled to the body. The faceplate may have a maximum thickness at a central location and a cross-section intersecting the central location. The cross-section may have continuously variable wall thickness across the faceplate and through the central location of the faceplate. The faceplate may have a closed non-convex contour curve defined by constant faceplate wall thickness that encloses the central location.

Disclosed is an example golf club that may include a head having a body and a faceplate coupled to the body. The faceplate may have a cross-section through a center point of the faceplate. The cross-section may have a continuously variable wall thickness, the faceplate forming a first closed non-convex contour curve defined by constant faceplate wall thickness and a second closed non-convex contour curve defined by faceplate wall thickness, enclosing the first closed non-convex contour curve. The second closed non-convex contour curve may defined by a constant wall thickness that differs by at least 0.2 mm from the constant wall thickness defining the second closed convex curve.

Disclosed is an example golf club that may include a head having a body and a faceplate coupled to the body. The faceplate may have a cross-section through a central location. The cross-section may have a thickness that undergoes a non-constant rate of change through the central location.

Figure 2:
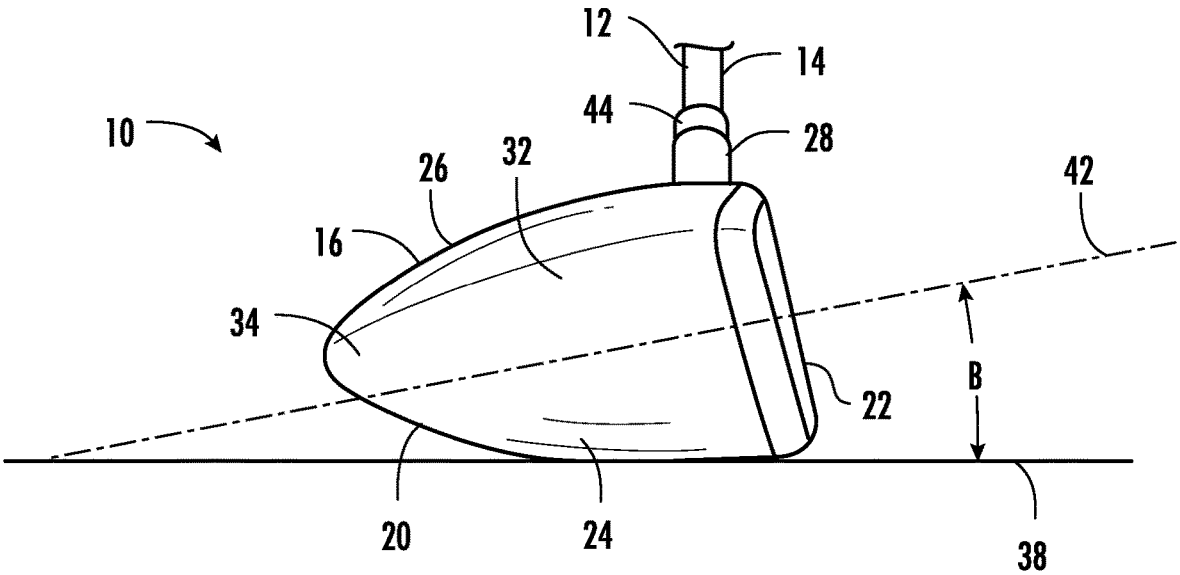
FIG. 2 is a side perspective of the golf club of FIG. 1.
Figure 3:
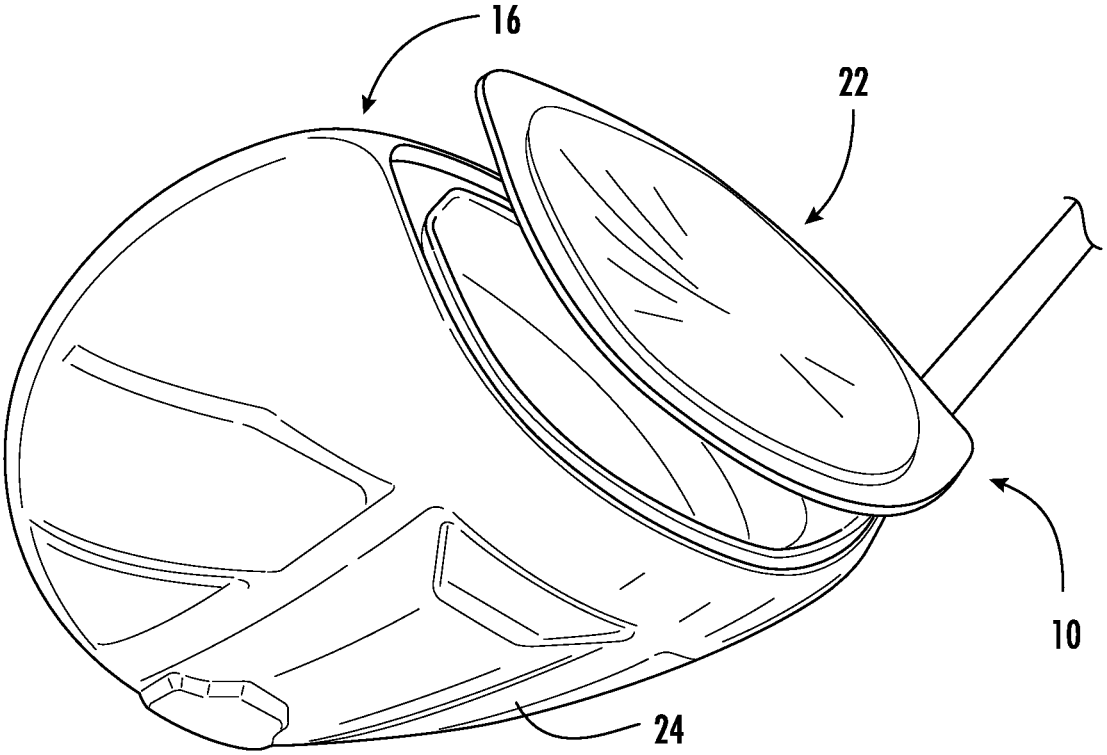
FIG. 3 is a front bottom exploded view of a golf club face positioned apart from another example golf club head.
Figure 4:
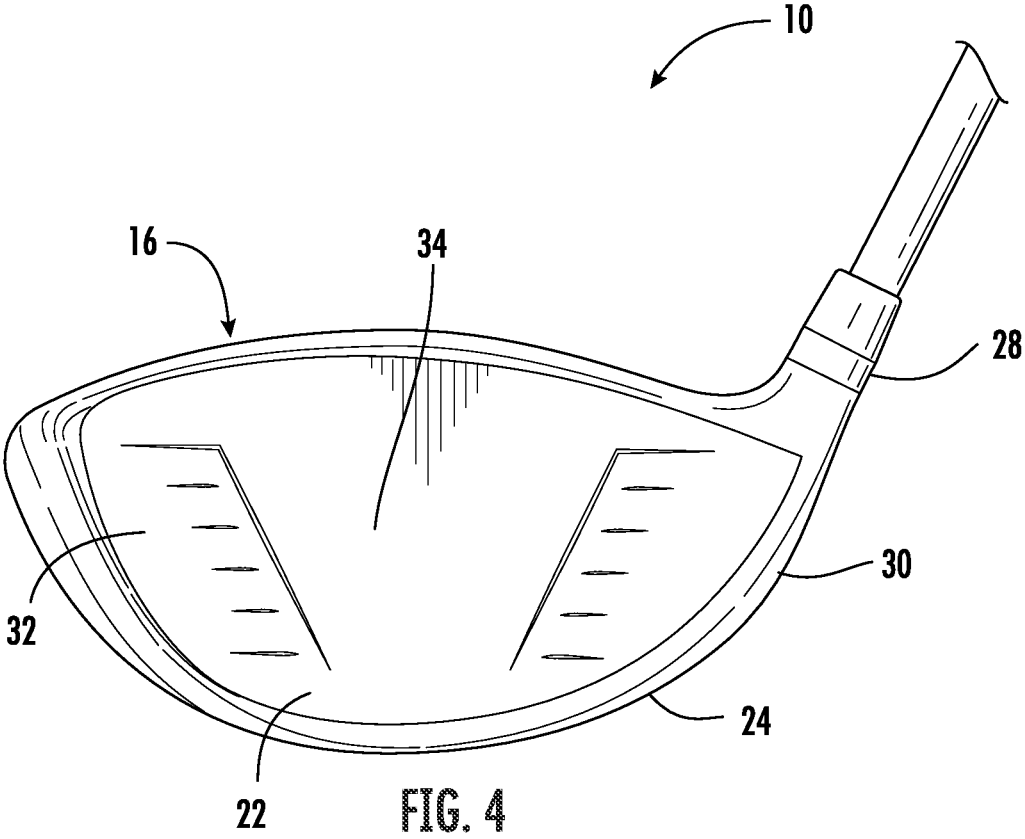
FIG. 4 is a front view of the golf club head of FIG. 3.
Figure 5:
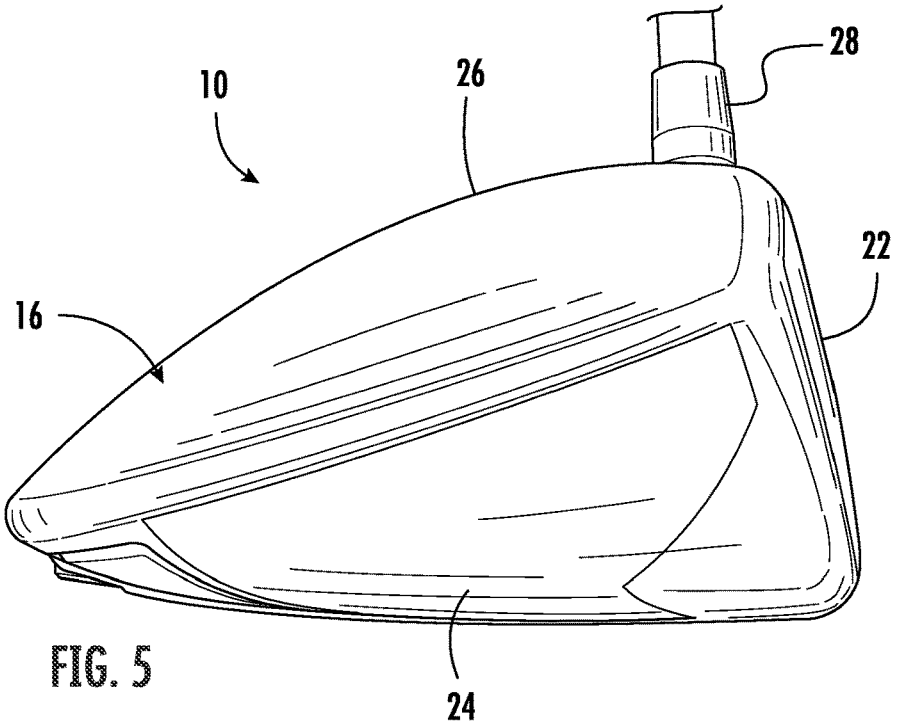
FIG. 5 is a toe end view of the golf club head of FIG. 3.
Figure 6:
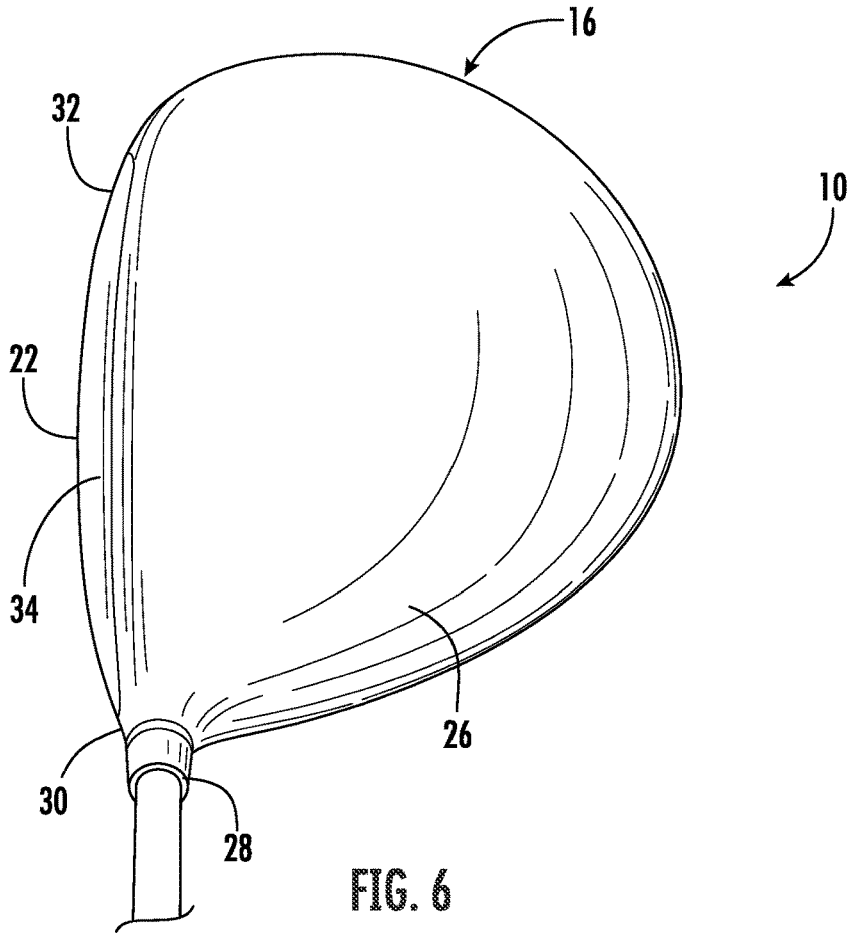
FIG. 6 is a top view of the golf club head of FIG. 3.
Figure 7:
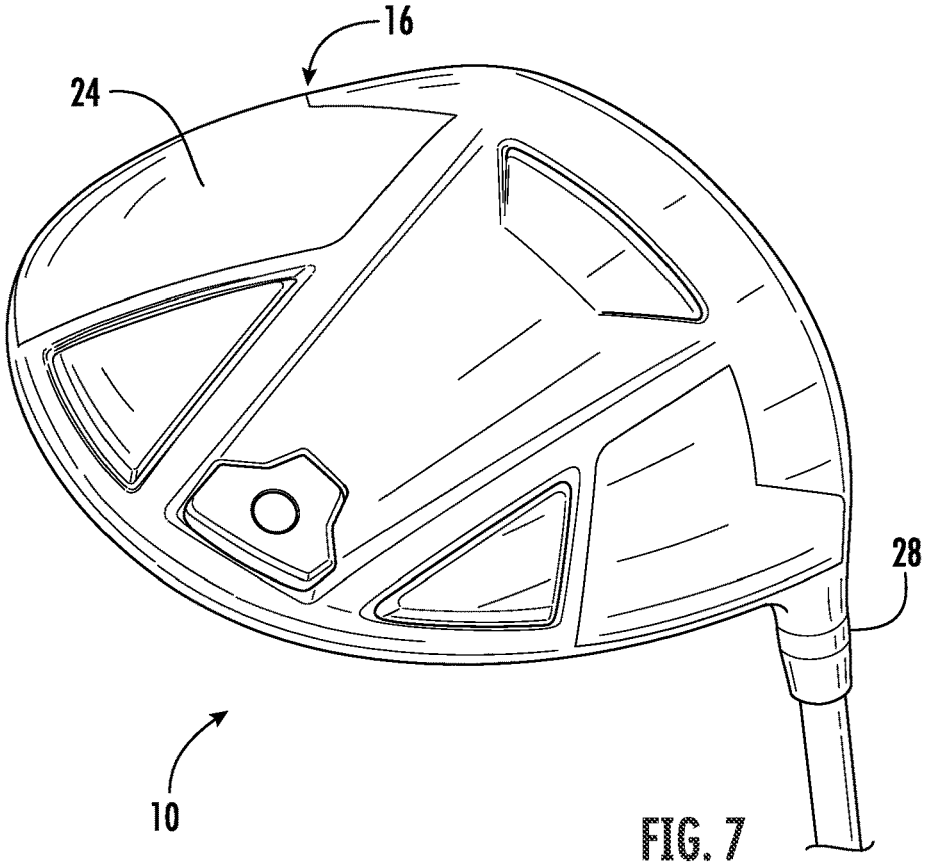
FIG. 7 is a rear sole perspective view of the golf club head of FIG. 3.
Figure 8:
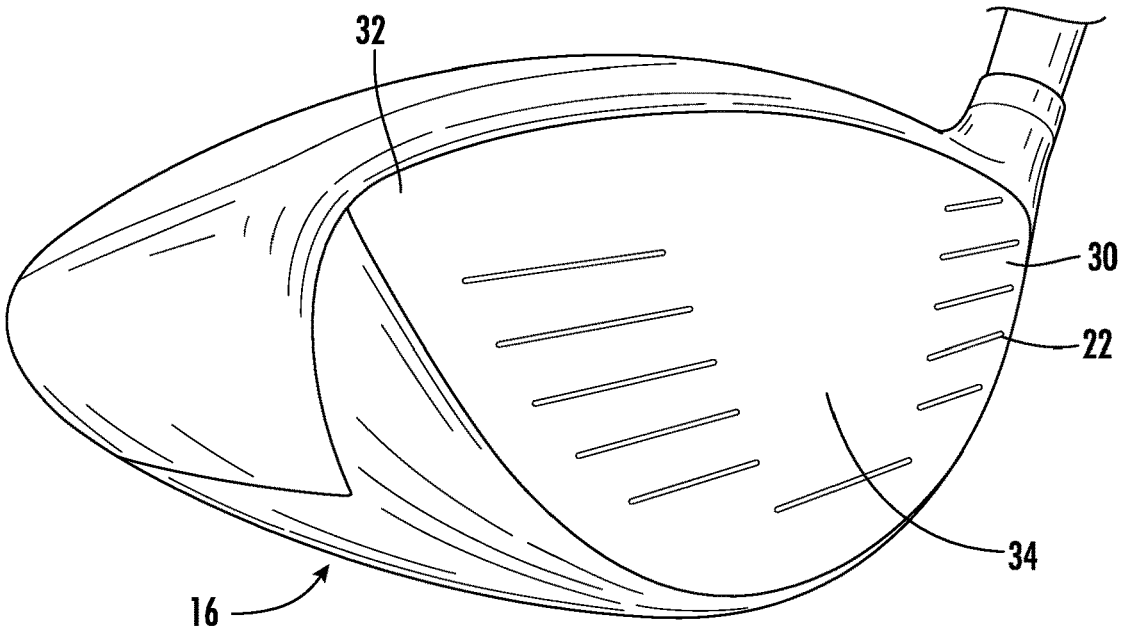
FIG. 8 is a front, toe end perspective view of the golf club head of FIG. 3.

Referring to FIGS. 1 and 2, a golf club is indicated generally at 10. The golf club 10 of FIG. 1 is configured as a driver. The present invention can also be formed as, and is directly applicable to, fairway woods, hybrids, irons, wedges, putters and combinations thereof in sets of golf clubs. The golf club 10 is an elongate implement configured for striking a golf ball and includes a golf shaft 12 having a butt end with a grip and a tip end 14 coupled to a club head 16.

The shaft 12 is an elongate hollow tube extending along a first longitudinal axis 18. The shaft 12 tapers toward the tip end 14. In one implementation, the tip end has an outside diameter of less than 0.400 inch. In other implementations, the outside diameter can be within the range of 0.335 to 0.370 inch. In example implementations, the outside diameter of the tip end 14 can be approximately 0.335-inch, 0.350-inch, 0.355 inch or 0.370 inch. The shaft 12 is formed of a lightweight, strong, flexible material, preferably as a composite material. In alternative embodiments, the shaft 12 can be formed of other materials such as, other composite materials, steel, other alloys, wood, ceramic, thermoset polymers, thermoplastic polymers, and combinations thereof. The shaft can be formed as one single integral piece or as a multi-sectional golf shaft of two or more portions or sections.

As used herein, the term "composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly example embodiments, the number layers can range from 3 to 8. In multiple layer constructions, the fibers can be aligned in different directions with respect to the longitudinal axis 18, and/or in braids or weaves from layer to layer. The layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon or thermoplastic materials. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of example embodiments, the resin is preferably a thermosetting resin such as epoxy or polyester resins. In other sets of example embodiments, the resin can be a thermoplastic resin. The composite material is typically wrapped about a mandrel and/or a comparable structure and cured under heat and/or pressure. While curing, the resin is configured to flow and fully disperse and impregnate the matrix of fibers.

The club head 16 includes a hollow body 20 that is coupled to the shaft 12. For purposes of this disclosure, the term "coupled" shall mean the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate member being attached to one another.

In one implementation, the club head 16 can be formed as a single unitary, integral body through a combination of casting and welding. In another implementation, the club head 10 can be formed through a combination of forging and welding. In other implementations, the components of the club head can be formed through casting, forging, welding, or a combination thereof. The body of the club head 16 includes a generally vertical front striking plate or strike face 22, a sole or sole plate 24, a crown 26 and a hosel portion 28. The striking face 22 extends from a heel portion 30 to a toe portion 32 of the club head 10. The sole 24 and the crown 26 rearwardly extend from lower and upper portions of the striking face 22, respectively. The sole 24 generally curves upward to meet the generally downward curved crown 26. The portion of the sole 24 adjacent the crown 26 that connects the sole 24 to the crown 26 at perimeter locations other than at the striking face 22 can be referred to as a side wall 34 or skirt. The hosel portion 28 is a generally cylindrical body that upwardly extends from the crown 26 at the heel portion 30 of the club head 16 to couple the club head 16 to the shaft 12. The hosel portion 28 defines an upper hosel opening 36 for receiving the tip end 14 of the shaft 12. The hosel portion 28 also defines a hosel longitudinal axis 40. The hosel portion 28 can also include alphanumeric and/or graphical indicia 44. The indicia 44 can represent one or more alignment markings, trademarks, designs, model nos., club characteristics, instructional information, other information, and combinations thereof. The club head 16 is made of a high tensile strength, durable material, preferably a stainless steel or titanium alloy. In one implementation, one or more portions of the club head 16 can be formed of an alloy, such as a titanium alloy, and other portions can be formed of a fiber composite material, such as the crown 26. Alternatively, the club head 10 can be made of other materials, such as, for example, a composite material, aluminum, other steels, metals, alloys, wood, ceramics or combinations thereof.

Referring to FIG. 1, the golf club 10 is shown on a ground plane 38 in a grounded address position. The golf club 10 has a lie position corresponds to a lie angle A defined as the angle between the hosel longitudinal axis 40 and the ground plane 38. In one implementation, the lie angle A is within the range of 50 to 66 degrees. Referring to FIG. 2, a toe portion view of the golf club 10 of FIG. 1 is shown. In the grounded address position, the loft position of the golf club 10 can be seen. The loft position corresponds to a loft angle B defined as the angle between a center striking face normal vector 42 and the ground plane 38 when the head is in a square face address position. In one implementation, the loft angle B is within the range of 6 to 15 degrees. In another implementation, the loft angle B is within the range of 8.5 to 11.5 degrees. In yet another implementation, the loft angle B is within the range 9.0 to 12.0 degrees. In other implementations, the loft angle B can be up to approximately 64 degrees.

Referring to FIGS. 3 through 8, the club head 16 of the golf club 10 is shown in greater detail. The faceplate 22 of the club head 16 has a heel portion 30, a toe portion 32 and a central region 34. The faceplate 22 is designed for peak kinetic response through an iterative, generative, artificial intelligence process that provides for a unique consistent, durable, high performing club head. The faceplate 22 of the club head 16 is made of a high tensile strength, durable material, preferably a titanium alloy. Alternatively, the faceplate can be made of other materials, such as, for example, a composite material, aluminum, other steels, metals, alloys, wood, ceramics or combinations thereof.

Figure 9:
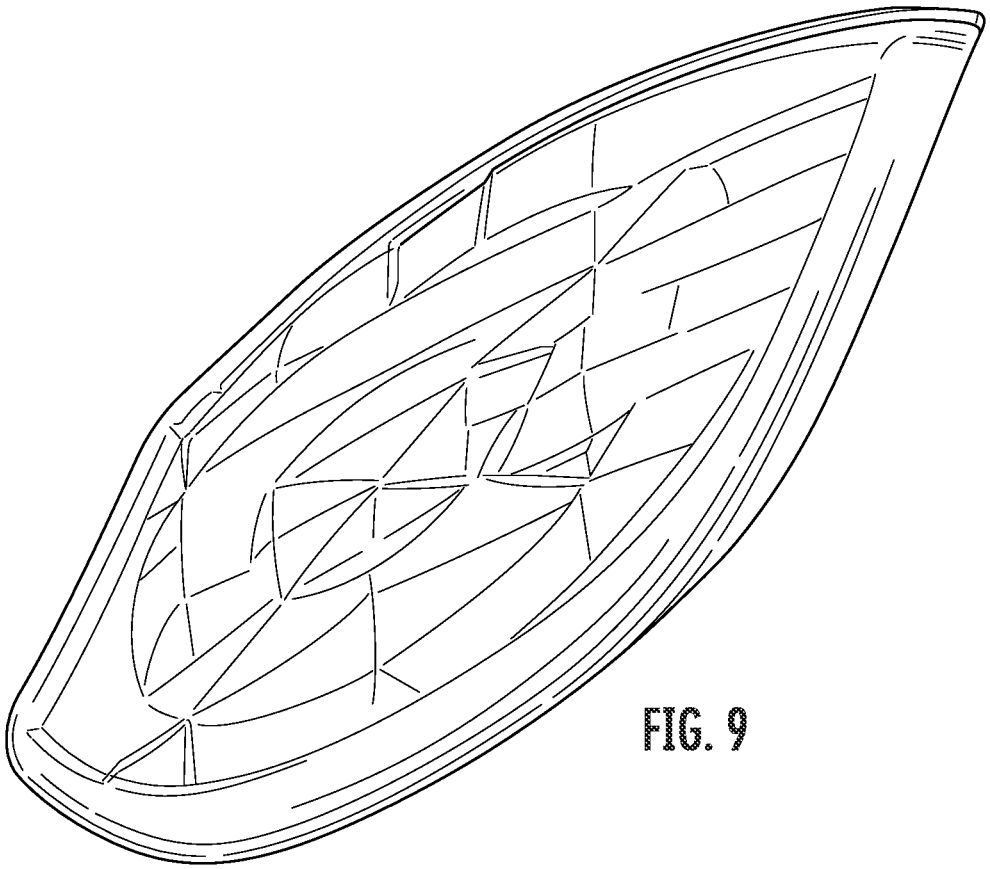
FIG. 9 is a rear side perspective view of an example face of a golf club head.
Figure 10:
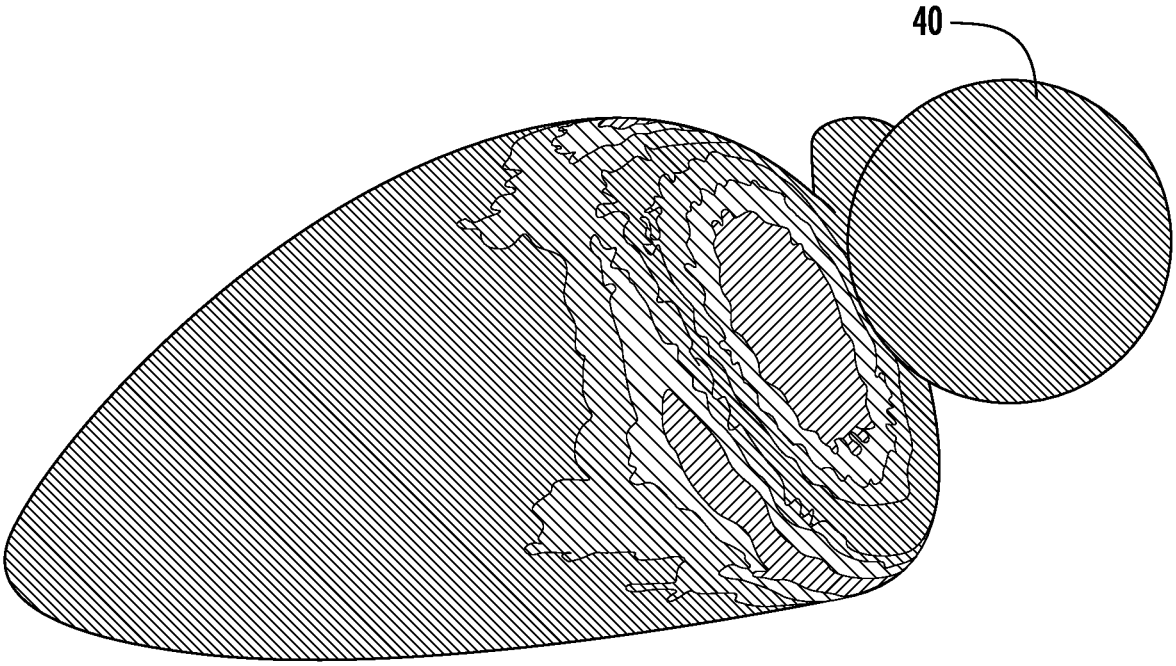
FIG. 10 is a front, toe end perspective view of a golf club head and a golf ball following a simulated impact with the golf club head.
Figure 27:
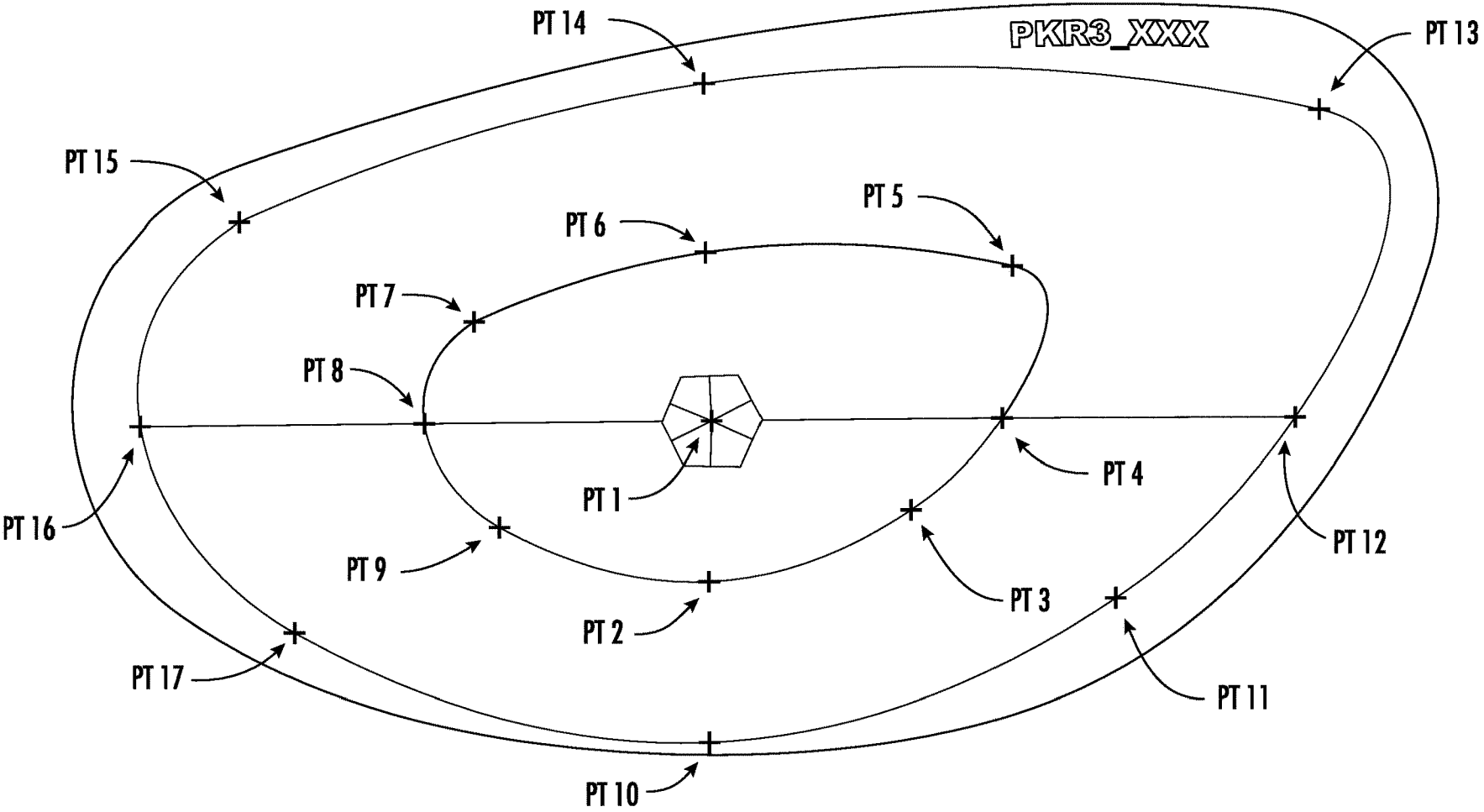
FIG. 27 is a front view of a faceplate of the golf club head of FIG. 3.

Referring to FIGS. 9 and 10, the artificial intelligence process includes a dynamic model employed to simulate the impact of a golf ball 40 against the faceplate 22 of the golf club head 16. The model simulates the golf ball 90 impacting the clubhead at a first predetermined incoming velocity. In one implementation, the first predetermined incoming velocity is 95 mph. In other implementations, other values for the predetermined incoming velocity can be used. A plurality of points, data points or simulated impact locations were selected about the faceplate 22. In one implementation, the dynamic analysis can use three data points about the faceplate 22 including a central point, a data point positioned between the toe and the central point, and another data point between the heel and the central point. In another implementation, the dynamic analysis can use five data points selected about the faceplate 22, in which two additional data points are utilized. One of the additional data points can be between the central point and the crown, and the second additional data point can be between the central point and the sole. In another implantation, six or nine data points can be utilized about the faceplate 22. In another implementation, seventeen data points can be used for the dynamic analysis of the faceplate 22. FIG. 27 illustrates one representation of the location of the seventeen different data points for the dynamic analysis. In other implementations, the dynamic analysis can use other quantities of data points below and above seventeen.

The dynamic analysis begins with an original faceplate design with an original set of faceplate thicknesses used for the selected number of data points. The dynamic analysis analyzes and calculates ball exit speeds from the simulated impacts at the selected number of data points or impact locations. Certain broad design limitations or constraints can be incorporated into the model such as, for example, a minimum faceplate thickness and/or a maximum faceplate thickness. The dynamic analyses then utilizes the prior determined ball exit velocity results to adjust the faceplate thickness at one or more of the data points and repeats the analysis. The dynamic analysis then examines the determined ball exit velocities from the second iteration of the analysis, and then repeats the process of adjusting the faceplate thickness of one or more of the data points. This iterative process is continuing for thousands of iterations until a selected set of faceplate thicknesses are determined for the selected number of data points. The iterative progressive dynamic analysis learns from prior iterations of the analysis to continue to fine tune and optimize the set of determined faceplate thicknesses. Referring to FIG. 27, in one implementation, the dynamic analysis was performed three separate times with different average faceplate thicknesses with three separate sets of faceplate thicknesses determined for seventeen data points as shown below.

| PT 1 | PT 2 | PT 3 | PT 4 | PT 5 | PT 6 | PT 7 | PT 8 | PT 9 |
|---|---|---|---|---|---|---|---|---|
| 0.174 | 0.129 | 0.114 | 0.139 | 0.099 | 0.124 | 0.114 | 0.119 | 0.109 |
| 0.169 | 0.124 | 0.109 | 0.134 | 0.094 | 0.119 | 0.109 | 0.114 | 0.104 |
| 0.179 | 0.134 | 0.119 | 0.144 | 0.104 | 0.129 | 0.119 | 0.124 | 0.114 |

| PT 10 | PT 11 | PT 12 | PT 13 | PT 14 | PT 15 | PT 16 | PT 17 | MASS (REF) |
|---|---|---|---|---|---|---|---|---|
| 0.117 | 0.114 | 0.109 | 0.119 | 0.114 | 0.084 | 0.094 | 0.124 | 38.8 g |
| 0.114 | 0.109 | 0.104 | 0.114 | 0.109 | 0.079 | 0.089 | 0.119 | 37.2 g |
| 0.119 | 0.119 | 0.114 | 0.124 | 0.119 | 0.089 | 0.099 | 0.129 | 40.3 g |

The seventeen data points were used to define a plurality of fractal zones about the faceplate 22. In dynamic analysis data set, the faceplate thicknesses varied within the range of to 0.084 to 0.174 inch among the seventeen data points. In a second dynamic analysis data set, the determined face thicknesses of the seventeen data points varied within the range of 0.079 to 0.169 inch. In another dynamic analysis data set, the determined faceplate thicknesses of the seventeen data points varied within the range of 0.089 to 0.179 inch.

The iterative, generative dynamic analysis uses the prior analyses to continue to build upon and optimize the analysis until it arrives at the selected desirable wall thickness designed to provide the highest and most balanced ball exit velocities about the faceplate. The dynamic analysis can be utilized to determine the group of faceplate thicknesses that provides the highest average ball exit velocity across the faceplate. In other implementations, the dynamic analysis can be utilized to determine the highest exit velocities for certain data point locations about the faceplate or for certain one or more fractal zones about the faceplate.

The iterative, generative dynamic analysis process can include selecting the number of fractal zones about the faceplate or selecting the number of data points for analysis about the faceplate. An initial set of faceplate thicknesses can be selected and the blend or transition of faceplate thicknesses from one data point location to another data point location. Based upon these inputs, the dynamic analysis arrives at an automated design, then simulates the impact of the golf ball at these data points. The simulated impact result in a determined ball exit speed at each of the data points. The dynamic analysis then incorporates the determined ball exit speeds from the completed iteration and adjusts the faceplate thicknesses at one or more of the data points and repeats the analysis, each time learning from the prior analysis iteration.

FIGS. 12 through 17 illustrate a few of the faceplate designs resulting from different iterative, generative dynamic analyses. The result is a faceplate 22 having unique variable faceplate thicknesses. The dynamic analysis can result in higher thicknesses at the center of the faceplate and then variable wall thicknesses in different radial directions from the center point. FIGS. 12 through 17 illustrate that the dynamic analysis produces non-uniform faceplate thicknesses across the faceplate. The faceplate thicknesses of FIG. 12 for example are not symmetrical with respect to a center point 50 in different direction radially from the center point 50.

Figure 23:
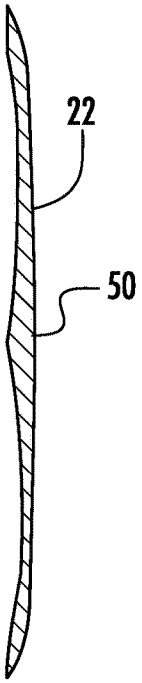
FIG. 23 is a cross-sectional view of the face of the golf club head taken along line 23-23 of FIG. 22.
Figure 22:
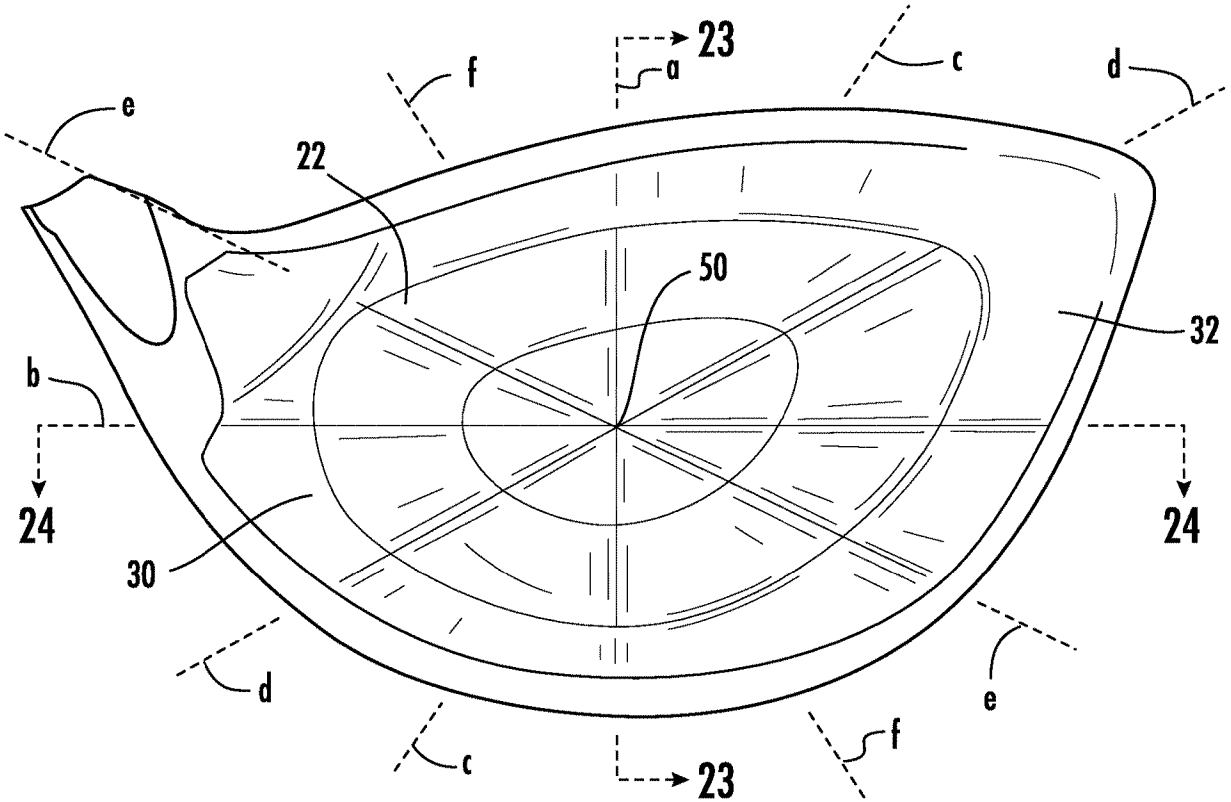
FIG. 22 is a rear perspective view of a face of a golf club head in accordance with another implementation.
Figure 24:
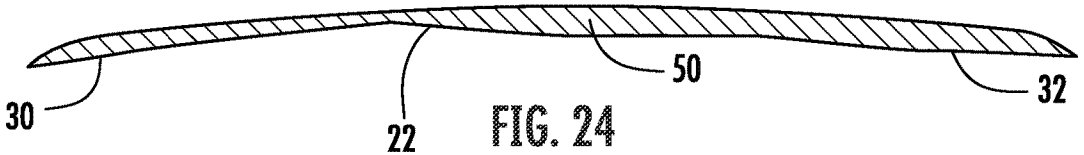
FIG. 24 is a cross-sectional view of the face of the golf club head taken along line 24-24 of FIG. 22.

FIGS. 22 through 24 illustrate another implementation of the faceplate 22 design resulting from the iterative, generative dynamic analysis. The faceplate thickness of the faceplate 22 of FIG. 22 varies from a center point 50 radially outward in different directions. For example, FIG. 23 illustrates the variation in faceplate thickness of the faceplate taken about plane a. Similarly, FIG. 24 illustrates the variation in faceplate thickness of the faceplate taken about plane b. Referring to FIG. 22, the faceplate thickness also varies from the center point 50 along plane c, plane d, plane e and plane f.

Figure 11A:
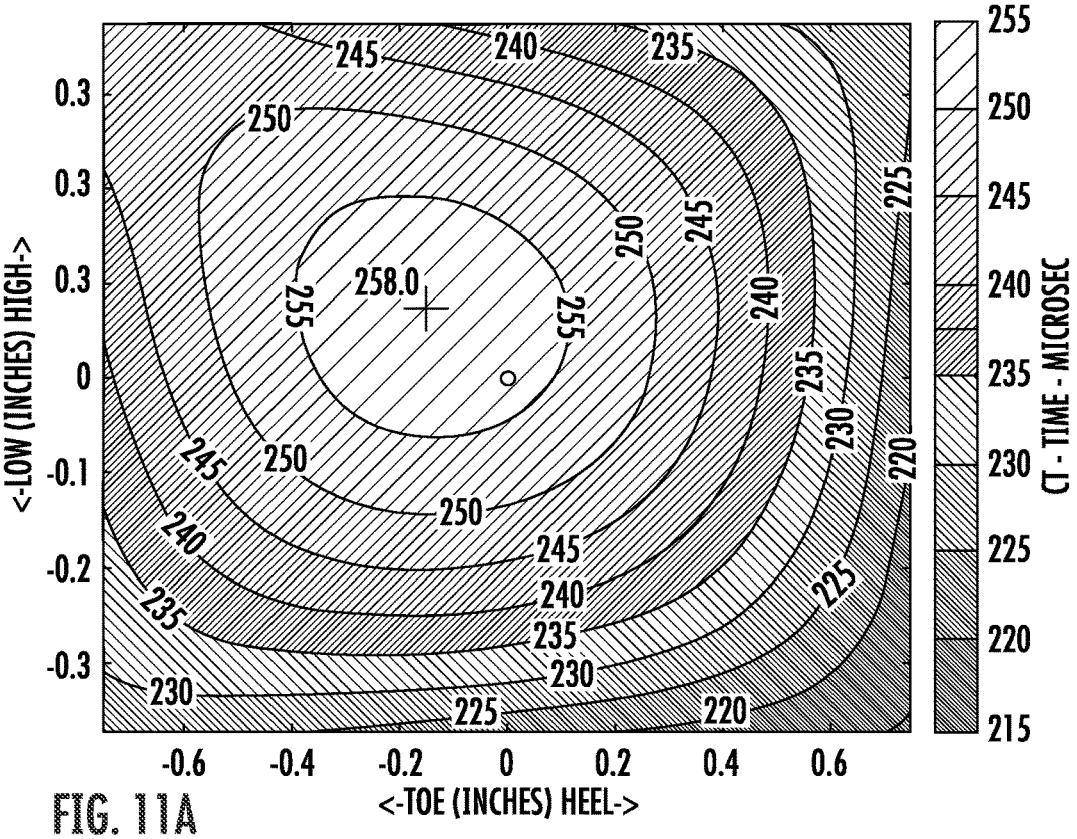
FIGS. 11A and 11B illustrate a pair of plots of characteristic time data of faces of golf club heads.
Figure 11B:
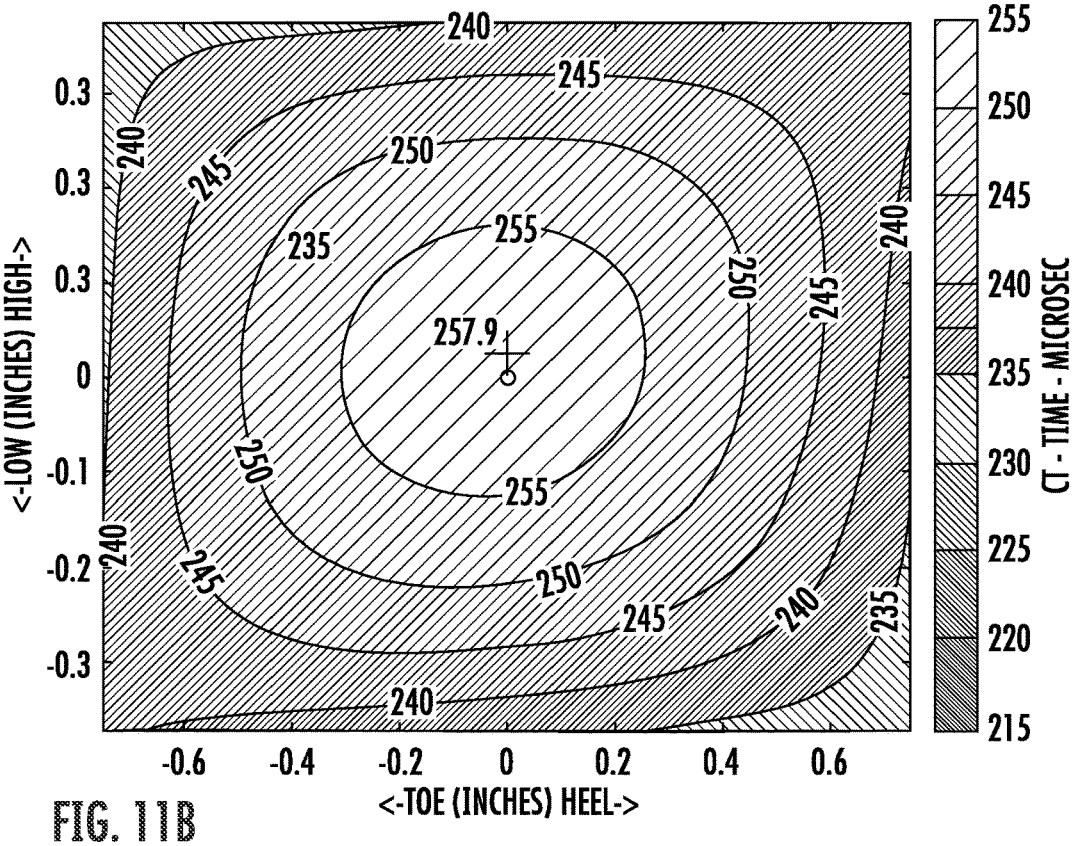

The dynamic analysis is used with other testing such as durability testing, characteristic time testing, actual ball exit velocity testing through an automated robot and actual field testing to arrive at an optimal faceplate design for a particular type of golfer, a particular application, or a particular golf club. FIGS. 11A and 11B illustrate the results of characteristic time (CT) testing performed on two faceplates 22 designed through the iterative dynamic analysis. The dynamic analysis allows for a higher and more consistent or more balanced CT result to be obtained across the faceplate.

Figure 18:
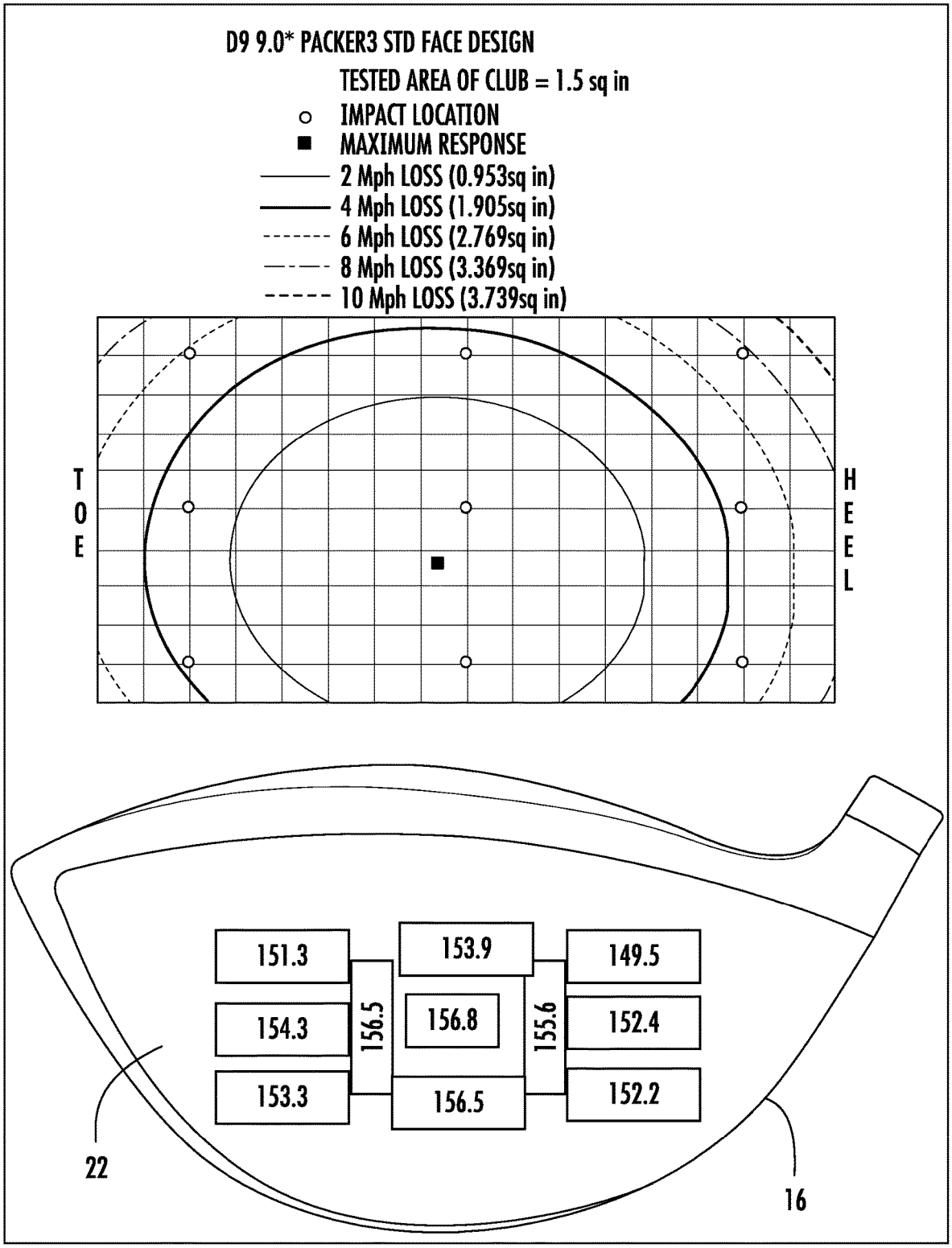
FIG. 18 is a graph of golf ball impact speeds measured at different locations about a face of one example implementation of a golf club head positioned above a front perspective view of the golf club head.
Figure 19:
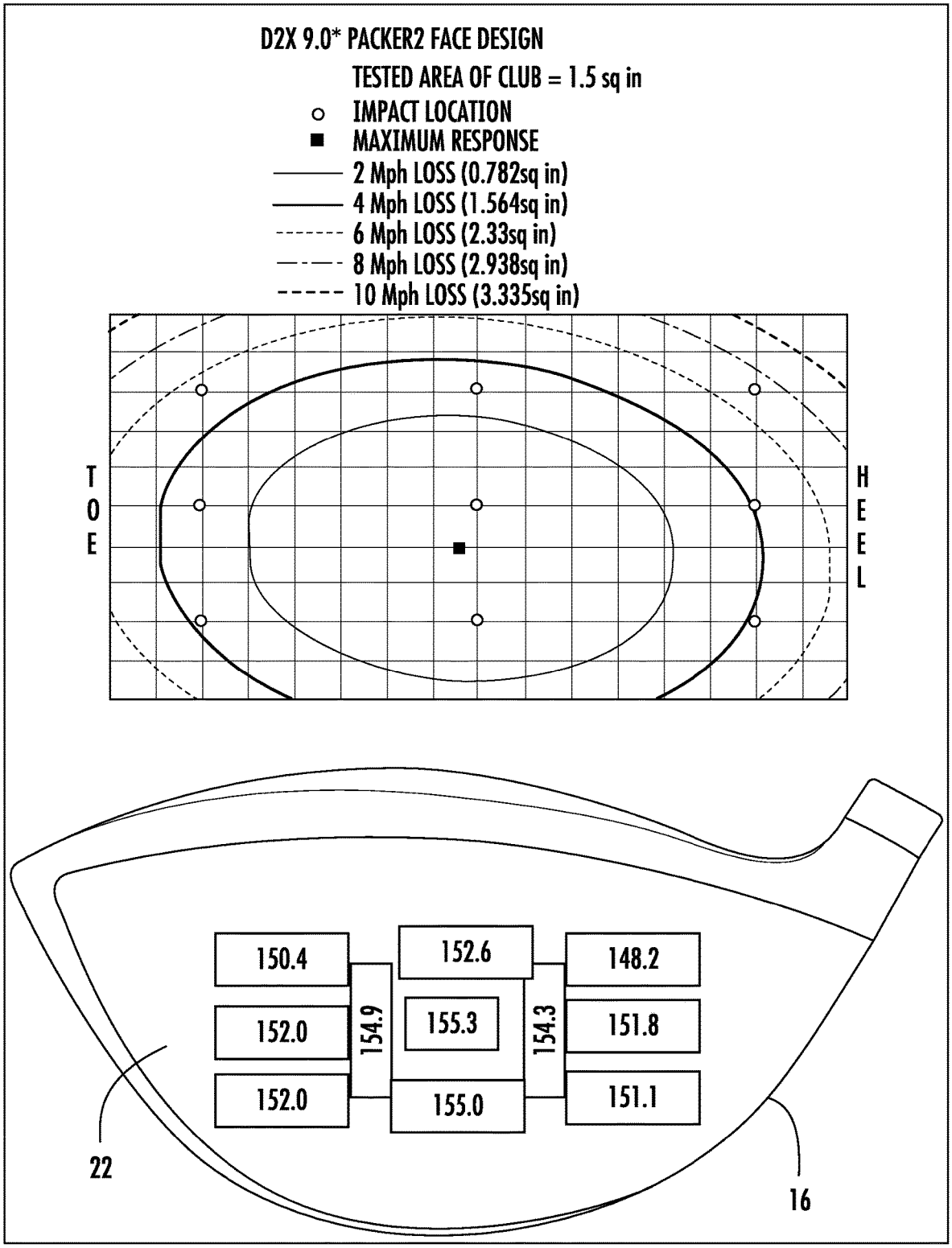
FIG. 19 is a graph of golf impact speeds measured at different locations about a face of another example implementation of a golf club head positioned above of a front perspective view of the golf club head.

FIGS. 18 and 19 illustrate actual ball exist velocity test results of golf club heads 16 incorporating a faceplate 22 resulting from the iterative, generative dynamic analysis design process. The lower portion of FIGS. 18 and 19 illustrate a front view of the golf club head 16 and the 9-impact locations used for collecting the data. An automated robot was used to impact golf balls at these discrete 9 impact locations. The robot produces a uniform repeatable golf swing. The graph above the front views of the golf club heads illustrates the relative ball exit speed at the 9 discrete locations about the faceplate 22 and identifies the regions of the faceplate where a 2-mph loss of ball exit speed occurs, where a 4-mph loss of ball exit speed occurs, where a 6 mph loss of ball exit speed occurs, where an 8 mph loss of ball exit speed occurs and where a 10 mph loss of ball exit speed occurs. The graphs illustrate the enlarged regions of exceptional performance of the golf club faceplate in terms of less than a 2-mph loss of ball exit speed, and the enlarged region of performance of less than a 4-mph loss of ball exit speed.

Figure 25:
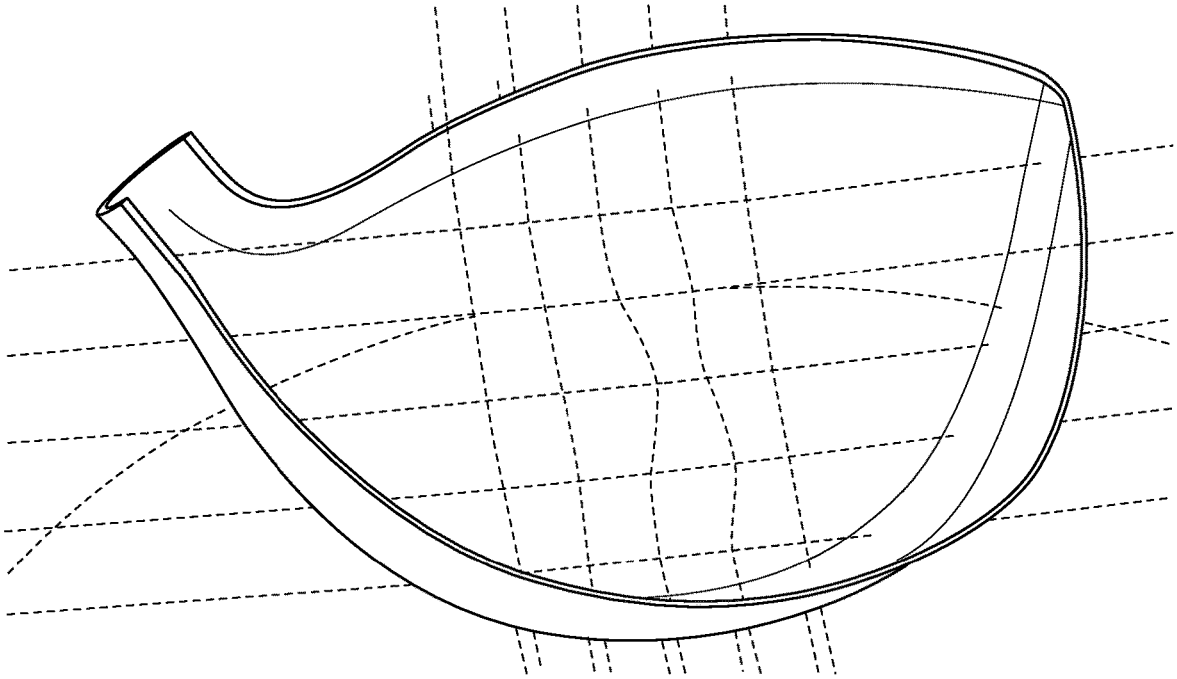
FIG. 25 is a rear view of a simulated face of a golf club head.
Figure 26:
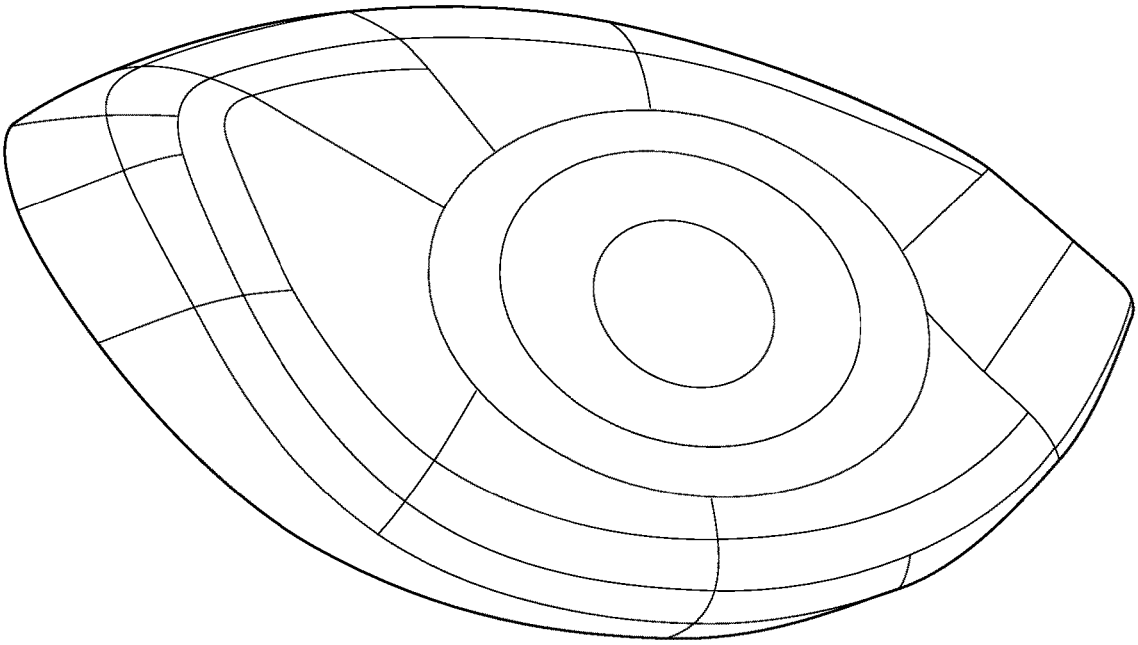
FIG. 26 is a front perspective view of a simulated face of a golf club head.

FIGS. 20 and 21 illustrate golf club performance data of two Wilson® D9™ golf clubs built in accordance with implementation of the present invention including with a faceplate 22 developed from the iterative, generative dynamic analysis process along with three commercial golf clubs of three competitive brands (Callaway Mavrik, Taylor Made Sims, and Ping G410). The golf club performance data was performed in field tests by low handicap golfers. The club head and ball characteristics were recorded using TrackMan technologies and other measuring devices. The results illustrate that the two Wilson® golf clubs perform favorably in club head speed, ball speed, launch angle, spin rate, carry distance and total distance. The Wilson® D9™ golf club includes a center of gravity values CGy (depth) of 1.552 in and CGz (height) of 1.06 and a moment of inertia (MOI) of 4589. FIGS. 25 and 26 illustrate 3D design drawings of golf club heads from the dynamic analysis.

Figure 12:
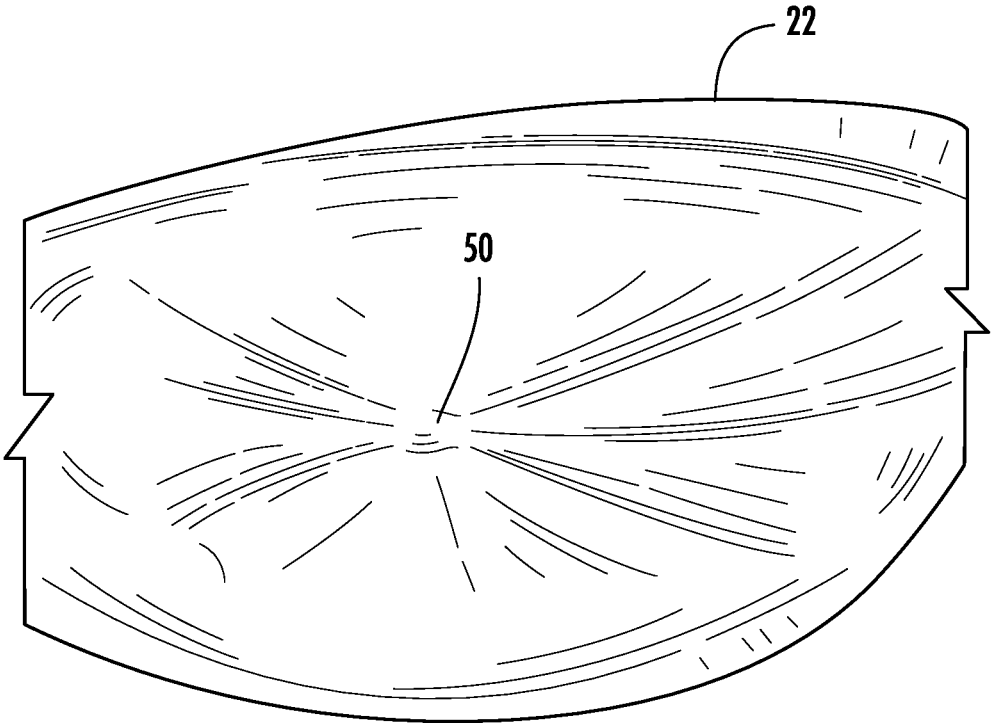
FIG. 12 is a rear perspective view of a face of a golf club head in accordance with one implementation of the present invention.
Figure 13:
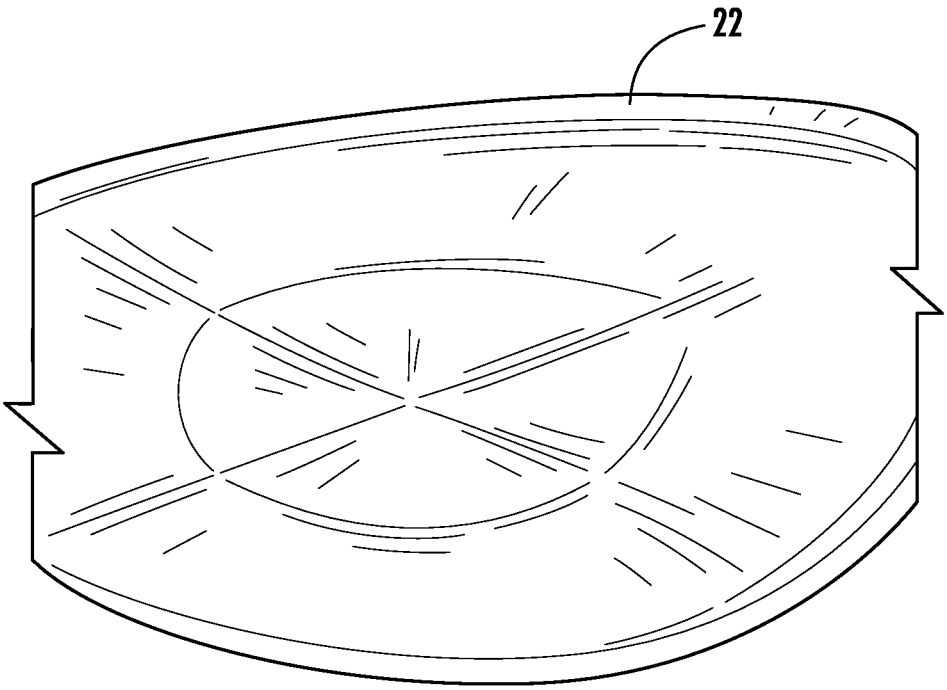
FIGS. 13 through 17 are rear perspective views of faces of golf club heads in accordance with other implementations.
Figure 14:
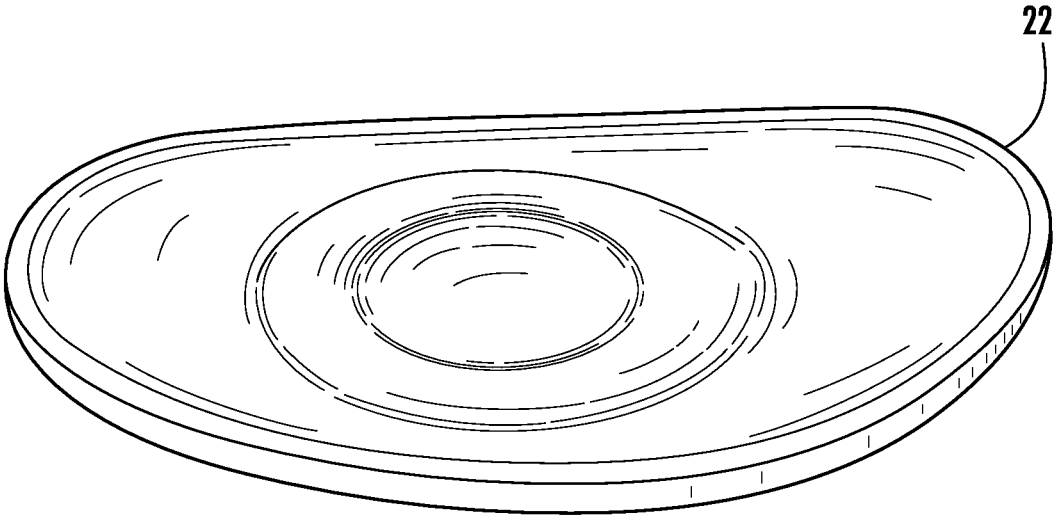
Figure 15:
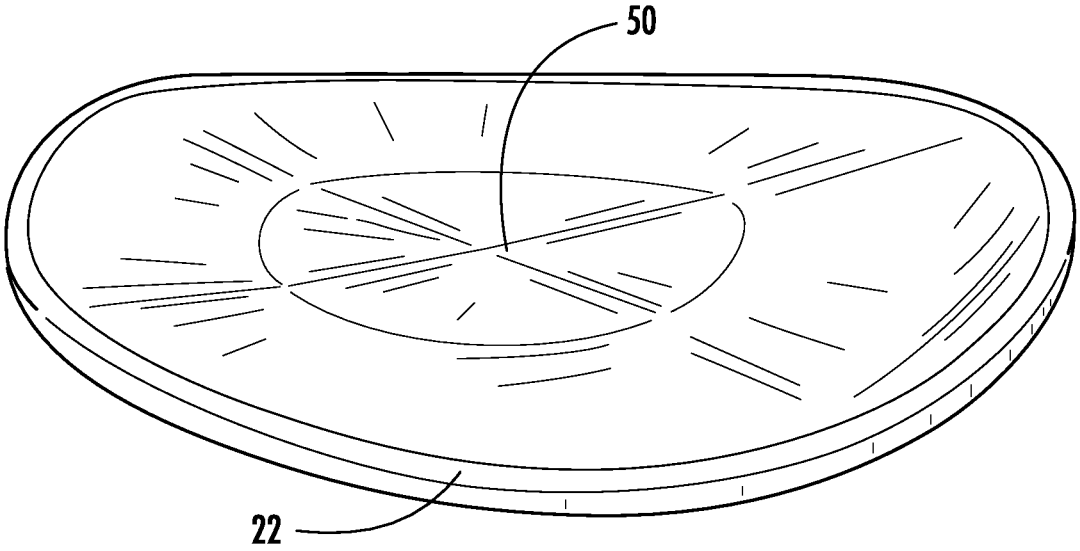
Figure 16:
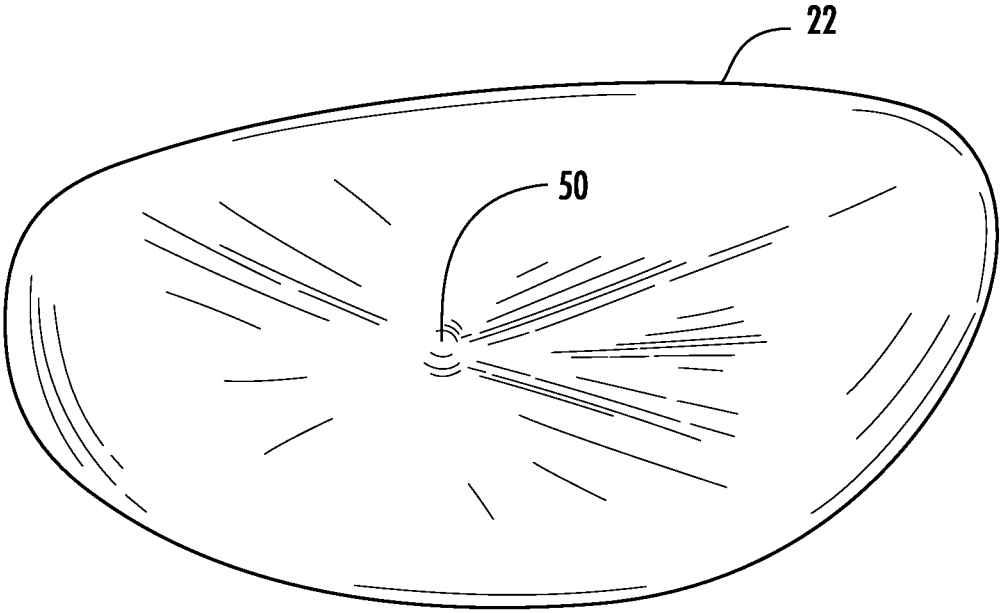
Figure 17:
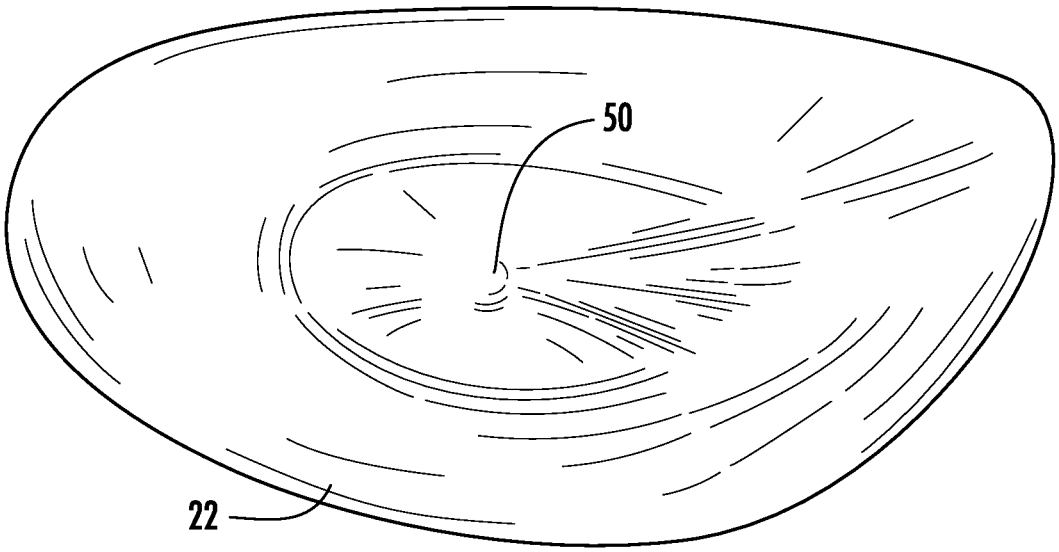
Figure 28:
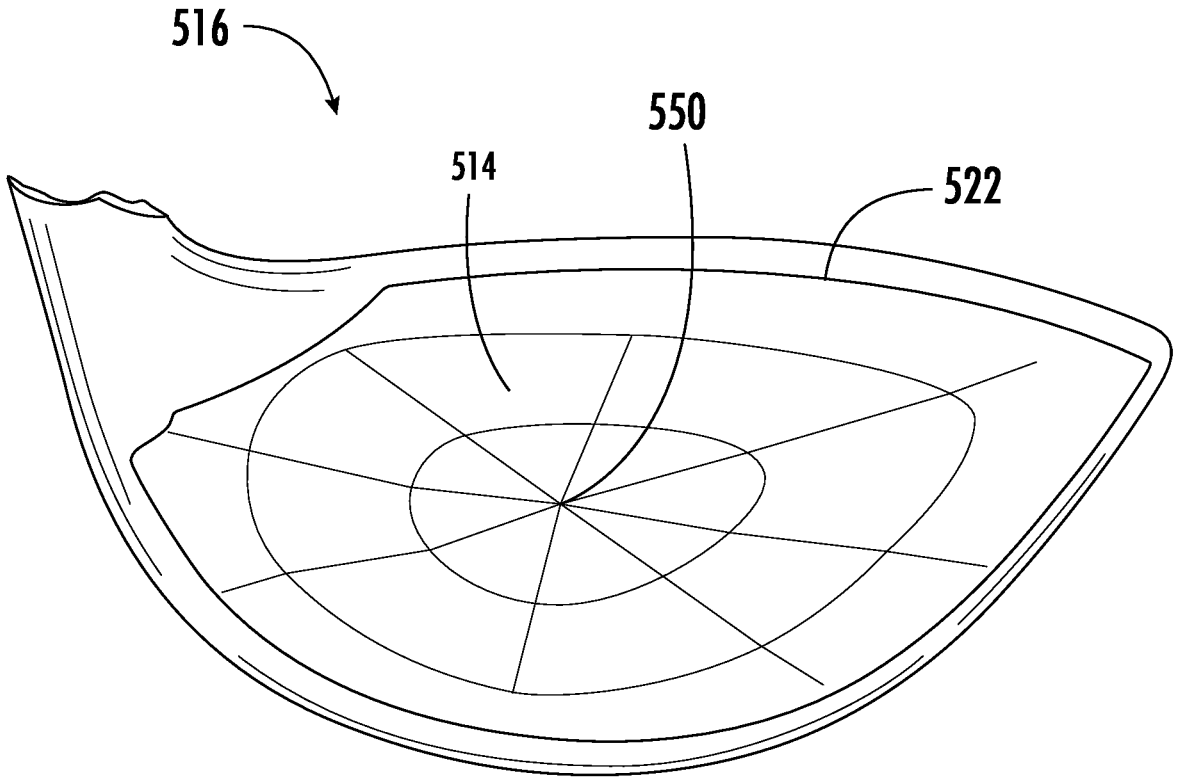
FIG. 28 is a rear perspective view of the faceplate of the example golf club head of FIG. 12.

FIG. 28 illustrates an inner surface 514 of a faceplate 522 of the golf club head 516 of FIG. 12 with its example faceplate 522. The inner surface 514 of the faceplate 522 defines, with the body of the golf club head, the interior volume of the golf club head and is also opposite of the outer or ball striking surface of the faceplate 522. FIG. 29 is a heat map depicting the different faceplate thicknesses across faceplate 522. Faceplate 522 has a maximum thickness at central location 550. Faceplate 522 has a continuously variable wall thickness across faceplate 522 such that the cross-section of faceplate 522 has a constantly changing thickness. This constantly changing thickness or continuously variable faceplate wall thickness may be seen by various cross-sections that intersect or pass through central location 550. In other implementations, the central location may not be the location of maximum faceplate wall thickness. In other implementations, the central location may be spaced apart from the location of maximum faceplate wall thickness by at least 1 mm.

Central location 550 may comprise to a center point of the striking face, or faceplate, of the golf club head 516. In some implementations, the central location 550 refers to the location on the striking face of the golf club head 516 having the largest characteristic time. The "characteristic time", CT, refers to the duration of time during which the struck golf ball resides in contact with a particular point on the surface of the striking face of the golf club. The CT is directly related to the flexibility of the golf club head. In some implementations, the central location 550 refers to the "high impact location" of the striking face of the golf club head 516, the location on the golf club head 516 that is a sweet spot or a desired hitting location of the strike face 522 of the golf club head 516. In some implementations, the high impact location is a location on the striking face that also has the largest CT. In some examples, the central location 550 also has a maximum thickness of faceplate 522.

Figure 29A:
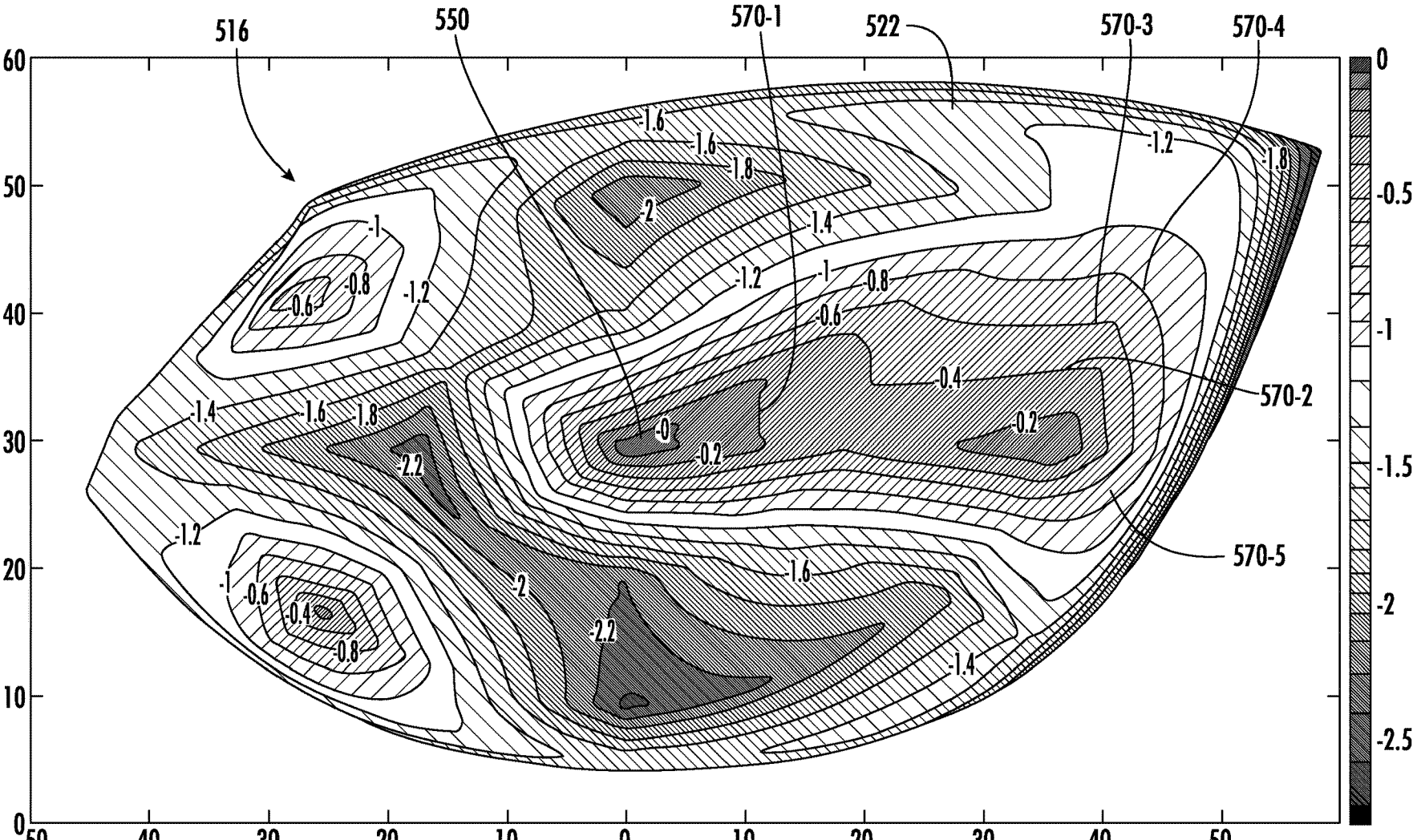
FIG. 29A is a heat map of a faceplate of the example golf club head of FIG. 28, the heat map illustrating example closed non-convex contour curves defined by constant faceplate wall thicknesses.

As shown by FIG. 29A, the continuously variable wall thickness of faceplate 522, viewable from cross-sections of the faceplate 522 that extend through the center point or central location 550 of the faceplate 522, forms a plurality of closed non-convex contour curves, each curve being defined by infinitesimal points of constant faceplate wall thickness. The closed non-convex contour curve is similar to a topographic curve or isoline, defining a closed loop line of points or locations along which the wall thickness is constant. The "non-convex" nature of the contour curve may be similar to that of a concave polygon or may be similar to a concave polygon or non-convex polygon except that the closed loop is formed by smooth curves rather than discrete interconnected line segments. In some implementations, the non-convex contour curve may be formed from both straight- or linear-line segments and smooth curves. The non-convex curve may have a concave portion or indentation such that a line segment may pass through the indentation, outside of the closed curve while its endpoints lie within the closed curve.

As shown by FIG. 29A, faceplate 522 has a continuously variable wall thickness, viewable from cross-sections of the faceplate 522 that extend through the center point or central location 550 of the faceplate 522, that forms closed non-convex contour curves 570-1, 570-2, 570-3, 570-4, 570-5 (collectively referred to as curves 570) and so on. Curves 570 enclosed central location 550 with curve 570-2 enclosing a 570-1, curve 570-3 closing curve 570-2, a 570-4 enclosing 570-3 and curve 570-5 in closing curve 570-4.

As further shown by FIG. 29A, the constant wall thickness defining each of curves 570 differs from the constant wall thickness of other curves 570 by thickness of at least 0.2 mm. FIG. 29 provides different thickness gradients relative to the maximum thickness of central location 550, or center point. For example, curve 570-2 has a constant wall thickness that is 0.4 mm less than the maximum thickness of central location 550, 0.2 mm less than the constant wall thickness that defines curve 570-1. Curve 570-3 is defined by a constant wall thickness that is 0.6 mm less than the maximum thickness of central location 550, 0.2 mm less than the constant thickness that defines curve 570-2. Curve 570-4 is defined by constant wall thickness that is 0.8 mm less than the constant wall thickness of central location 550, 0.2 mm less than the constant wall thickness that defines curve 570-3. Curve 570-5 is defined by constant wall thickness that is 0.1 mm less than the constant wall thickness of central location 550, 0.2 mm less than the constant wall thickness that defines curve 570-4.

Figure 29B:
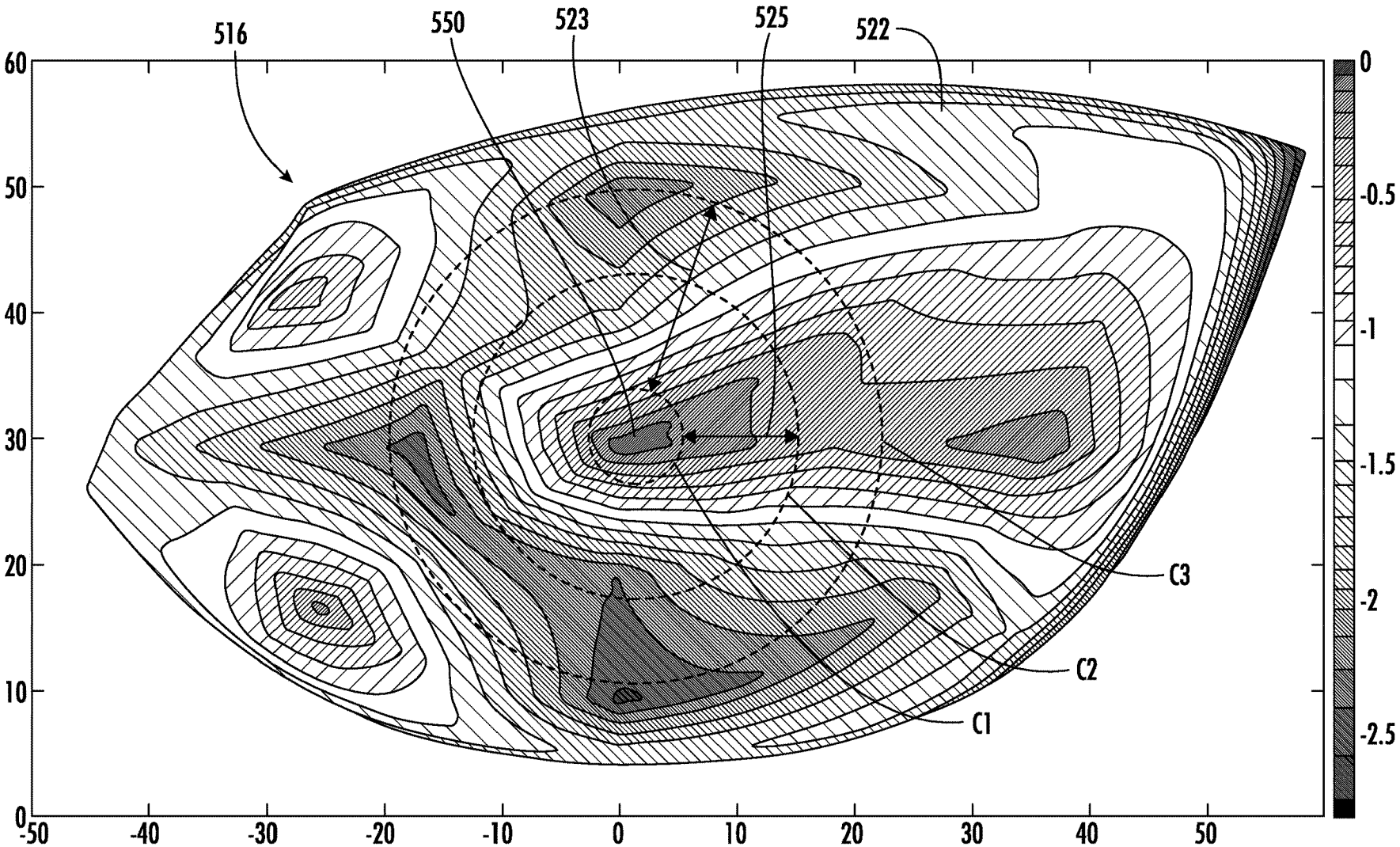
FIG. 29B is the heat map of the faceplate of FIG. 29A additionally showing first and second central annular regions of the faceplate about a central location.

Referring to FIG. 29B, the faceplate 522 has no area of constant faceplate wall thickness greater than 1 $mm^2$. Additionally, the faceplate 522 omits any closed convex contour curves defined by constant faceplate wall thickness within a first central annular region 523 of the faceplate 522. The first central annular region 523 encircles the central location 550, and is defined by an inner circle having radius of 2 mm (dashed circle C1) from the central location 550, and an outer circle having a radius of 20 mm (dashed circle C3) from the central location 550. In other implementations, the faceplate 522 omits any closed convex contour curves defined by constant faceplate wall thickness within a second central annular region 525 of the faceplate 522. The second central annular region 525 encircles the central location 550, and is defined by the circle C1 and an outer circle having a radius of 13 mm (dashed circle C2) from the central location 550. In other words, in one implementation, no closed convex contour curve defined by infinitesimal points of constant faceplate wall thickness can be found or identified within the first annular regions 523 of the faceplate 522. In another implementation, no closed convex contour curve defined by infinitesimal points of constant faceplate wall thickness can be found or identified within the second annular regions 525 of the faceplate 522. In other implementations, the values of the radiuses of dashed circles C1, C2 and C3 can be varied. In other implementations, dashed circle may have a radius extending from the central location 550 within the range of 0.25 mm to 3.0 mm. In other implementations, dashed circle C2 may have a radius extending from the central location 550 within the range of 6.0 mm to 18 mm. In other implementations, dashed circle may have a radius extending from the central location 550 within the range of 15 mm to 30 mm.

In another implementation, the faceplate 522 has a continuously variable faceplate wall thickness, when viewed from a cross-section of the faceplate extending through the central location 550, within the first annular region 523 of the faceplate 522. In another implementation, the faceplate 522 has a continuously variable faceplate wall thickness, when viewed from a cross-section of the faceplate extending through the central location 550, within the second annular region 525 of the faceplate 522.

In another implementation, at least a first closed non-convex contour curve defined by a first constant faceplate wall thickness can be identified within the area defined by the diameter of dashed circle C3. In another implementation, at least first and second closed non-convex contour curves can be identified within the area defined by the diameter of dashed circle C3, wherein the first and second closed non-convex contour curves define first and second constant faceplate wall thicknesses, respectively, and wherein the first constant faceplate wall thickness and the second constant faceplate wall thickness having a faceplate wall thickness difference of at least 0.2 mm. Additionally, in one implementation, the second closed non-convex contour curve within the area defined by the diameter of dashed circle C3 can enclose the first closed non-convex contour curve within the area defined by the dashed circle C3.

As further shown by FIG. 29A, the contour of the inner surface 514 of the faceplate 522 is devoid of any projections that form a closed loop about the center point 550. In other words, the faceplate 550 does not include variations of faceplate wall thicknesses that result in the contour of the inner surface 514 of the faceplate 522 having regions of increased faceplate thickness that form any closed loop projections surrounding or enclosing the center point 550 and that would extend into the void or interior volume of the golf club head. The inner surface 514 of the faceplate 522 is devoid of any such closed loop rings, ellipses, or other closed loop shapes formed by regions of increased wall thickness surrounding the center point 550.

Figure 30:
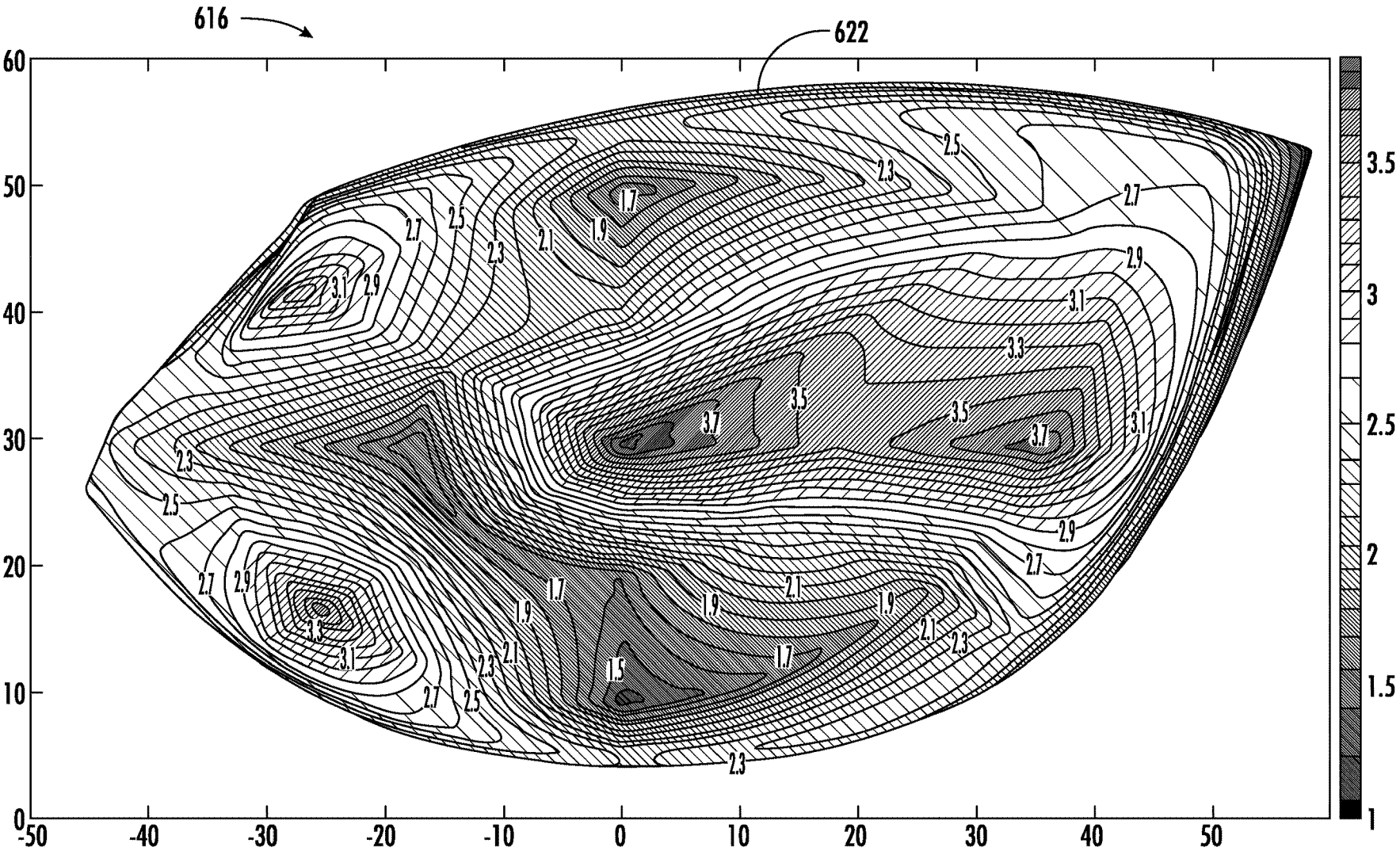
FIG. 30 is a heat map of a faceplate of an example golf club head.

FIG. 30 illustrates portions of an example golf club head 616. FIG. 30 is a heat map illustrating the various cross-sectional thicknesses of faceplate 622. Faceplate 622 is similar to faceplate 522 except that faceplate 622 forms closed non-convex contour curves defined by the particular depicted example constant faceplate wall thicknesses. As with faceplate 522, faceplate 622 has a continuously variable wall thickness across faceplate 622 and forms a series of inter-nested closed non-convex contour curves, wherein at least two consecutive curves are defined by constant wall thicknesses that differ by at least 0.2 mm.

Figure 31:
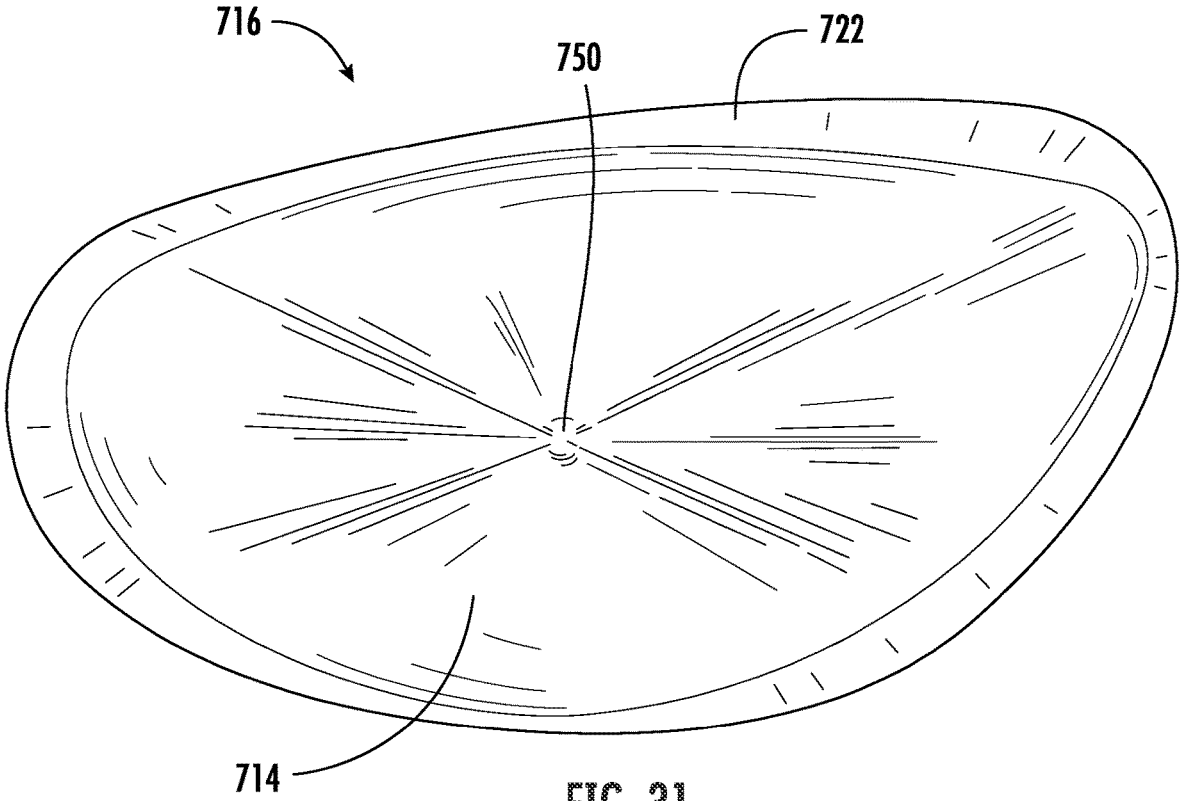
FIG. 31 is a rear perspective view a faceplate of an example golf club head.

FIG. 31 illustrates an inner surface 714 of a faceplate 722 of an example golf club head 716. FIG. 31 is a heat map depicting the different thicknesses across faceplate 722. Faceplate 722 has a maximum thickness at a central location 750 or central point. Faceplate 722 has a continuously variable wall thickness across faceplate 722 such that the cross-section of faceplate 722 has a constantly changing thickness. This constantly changing thickness or continuously variable wall thickness may be seen by various cross-sections that intersect or pass through central location 750.

Central location 750 (sometimes referred to as a center point) may comprise to a center point of the striking face of the golf club head 516. In some implementations, the central location 750 refers to the location on the striking face of the golf club head 716 having the largest characteristic time. The "characteristic time", CT, refers to the duration of time during which the struck golf ball resides in contact with a particular point on the surface of the striking face of the golf club. In some implementations, the central location 750 refers to the "high impact location" of the striking face of the golf club head 716, the location on the golf club head 716 that is a sweet spot or desired hitting location of the strike face 722 of the golf club head 716. In some implementations, the high impact location is a location on the striking face that also has the largest CT. In the examples, the central location 750 also has a maximum thickness of faceplate 722.

Figure 32A:
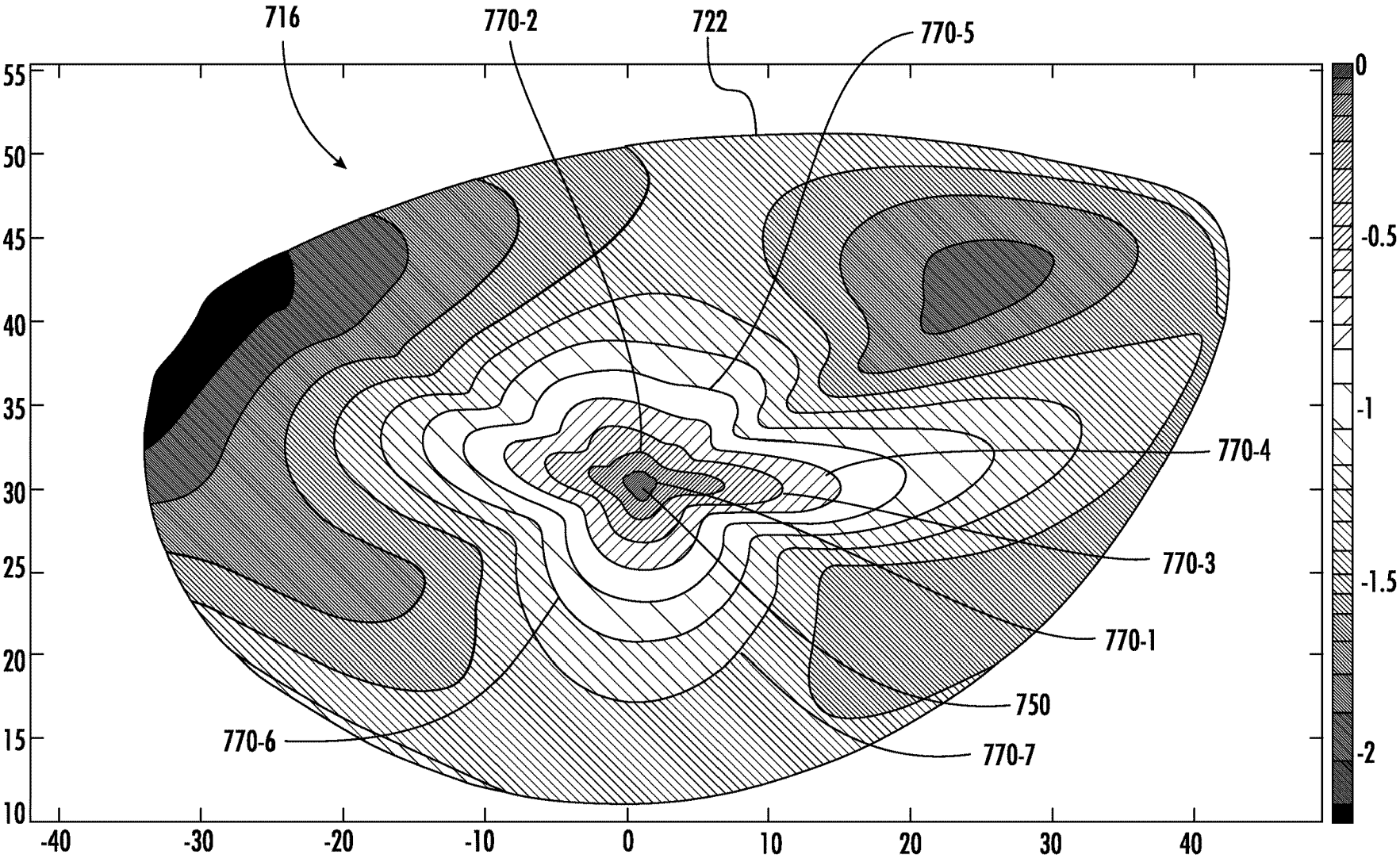
FIG. 32A is a heat map of a faceplate of the example golf club head of FIG. 30, the heat map illustrating example closed non-convex contour curves defined by constant faceplate wall thicknesses.

As shown by FIG. 32A, the continuously variable wall thickness of faceplate 722 forms a plurality of closed non-convex contour curves, each curve being defined infinitesimal points of constant faceplate wall thickness. The closed non-convex contour curve is similar to a topographic curve or isoline, defining a closed loop line of points or locations along which the wall thickness is constant. The "non-convex" nature of the contour curve may be similar to that of a concave polygon or may be similar to a concave polygon or non-convex polygon except that the closed loop is formed by smooth curves rather than discrete interconnected line segments. In some implementations, the non-convex contour curve may be formed from both straight- or linear-line segments and smooth curves. The non-convex curve may have a concave portion or indentation such that a line segment may pass through the indentation, outside of the closed curve while its endpoints lie within the closed curve.

As shown by FIG. 32A, faceplate 722 as a continuously variable wall thickness that forms closed non-convex contour curves 770-1, 770-2, 770-3, 770-4, 770-5, 770-6, and 770-7 (collectively referred to as curves 770) and so on.

Curves 770 enclose central location 750 with curve 570-1 enclosing central location 750, curve 570-2 enclosing curve 770-1, curve 770-3 enclosing curve 770-2, curve 770-4 enclosing curve 770-3, curve 770-5 enclosing curve 770-4, curve 770-6 enclosing curve 770-5 and curve 770-7 enclosing curve 570-6.

As further shown by FIG. 32A, the constant wall thickness defining each curve 770 differs from the constant wall thickness of other curves 770 by thickness of at least 0.2 mm. FIG. 32A provides different thickness gradients relative to the maximum thickness of central location 750. For example, curve 770-2 is defined by a constant faceplate wall thickness that is 0.2 mm less than the maximum thickness of central location 550, 0.2 mm less than the constant wall thickness that defines curve 770-1. Curve 770-3 is defined by a constant wall thickness that is 0.4 mm less than the maximum thickness of central location 750, 0.2 mm less than the constant thickness that defines curve 770-2. Curve 770-4 is defined by constant wall thickness that is 0.6 mm less than the constant wall thickness of central location 750, 0.2 mm less than the constant wall thickness that defines curve 770-3. Curve 770-5 is defined by constant wall thickness that is 0.8 mm less than the constant wall thickness of central location 750, 0.2 mm less than the constant wall thickness that defines curve 770-4. Curve 770-6 is defined by constant wall thickness that is 1 mm less than the constant wall thickness of central location 750, 0.2 mm less than the constant wall thickness that defines curve 770-5. Curve 770-7 is defined by constant wall thickness that is 1.2 mm less than the constant wall thickness of central location 750, 0.2 mm less than the constant wall thickness that defines curve 770-6.

Figure 32B:
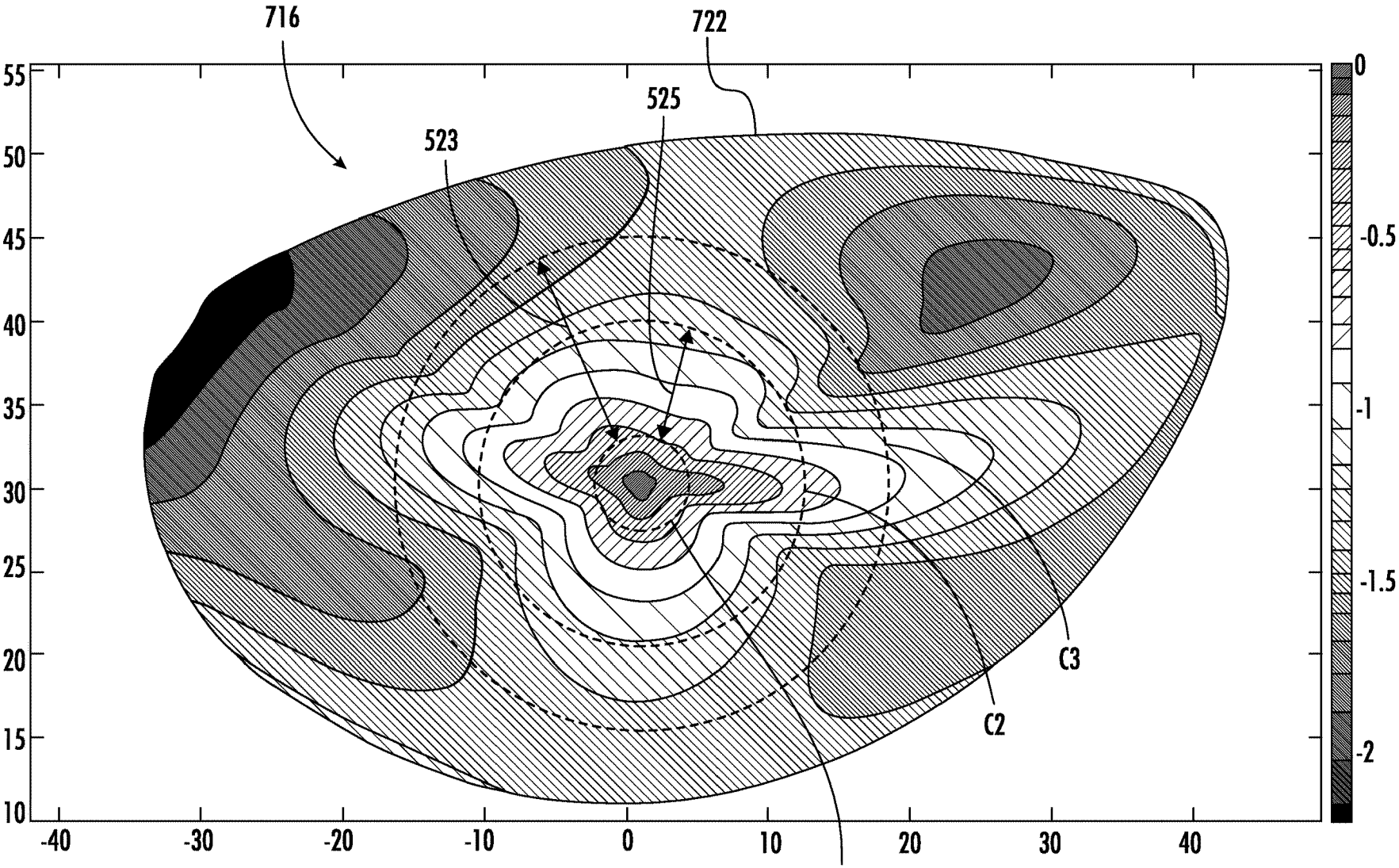
FIG. 32B is the heat map of the faceplate of FIG. 32A additionally showing first and second central annular regions of the faceplate about a central location.

As further shown by FIG. 32B, the faceplate 722 has no area of constant faceplate wall thickness greater than 1 $mm^2$. Additionally, the faceplate 722 omits any closed convex contour curves defined by constant faceplate wall thickness within a first central annular region 723 of the faceplate 722. The first central annular region 723 encircles the central location 750, and is defined by an inner circle having radius of 2 mm (dashed circle C1) from the central location 750, and an outer circle having a radius of 20 mm (dashed circle C3) from the central location 750. In other implementations, the faceplate 722 omits any closed convex contour curves defined by constant faceplate wall thickness within a second central annular region 725 of the faceplate 722. The second central annular region 725 encircles the central location 750, and is defined by the circle C1 and an outer circle having a radius of 13 mm (dashed circle C2) from the central location 750. In other words, in one implementation, no closed convex contour curve defined by infinitesimal points of constant faceplate wall thickness can be found or identified within the first annular regions 723 of the faceplate 722. In another implementation, no closed convex contour curve defined by infinitesimal points of constant faceplate wall thickness can be found or identified within the second annular regions 725 of the faceplate 722. In other implementations, the values of the radiuses of dashed circles C1, C2 and C3 can be varied. In other implementations, dashed circle may have a radius extending from the central location 750 within the range of 0.25 mm to 3.0 mm. In other implementations, dashed circle C2 may have a radius extending from the central location 7550 within the range of 6.0 mm to 18 mm. In other implementations, dashed circle may have a radius extending from the central location 750 within the range of 15 mm to 30 mm.

As further shown by FIG. 32A, the contour of the inner surface 714 of the faceplate 722 is devoid of any projections that form a closed loop about the center point 750. In other words, the faceplate 750 does not include variations of faceplate wall thicknesses that result in the contour of the inner surface 714 of the faceplate 722 having regions of increased faceplate thickness that form any closed loop projections surrounding or enclosing the center point 750 and that would extend into the void or interior volume of the golf club head. The inner surface 714 of the faceplate 722 is devoid of any such closed loop rings, ellipses, or other closed loop shapes formed by regions of increased wall thickness surrounding the center point 750.

Figure 33:
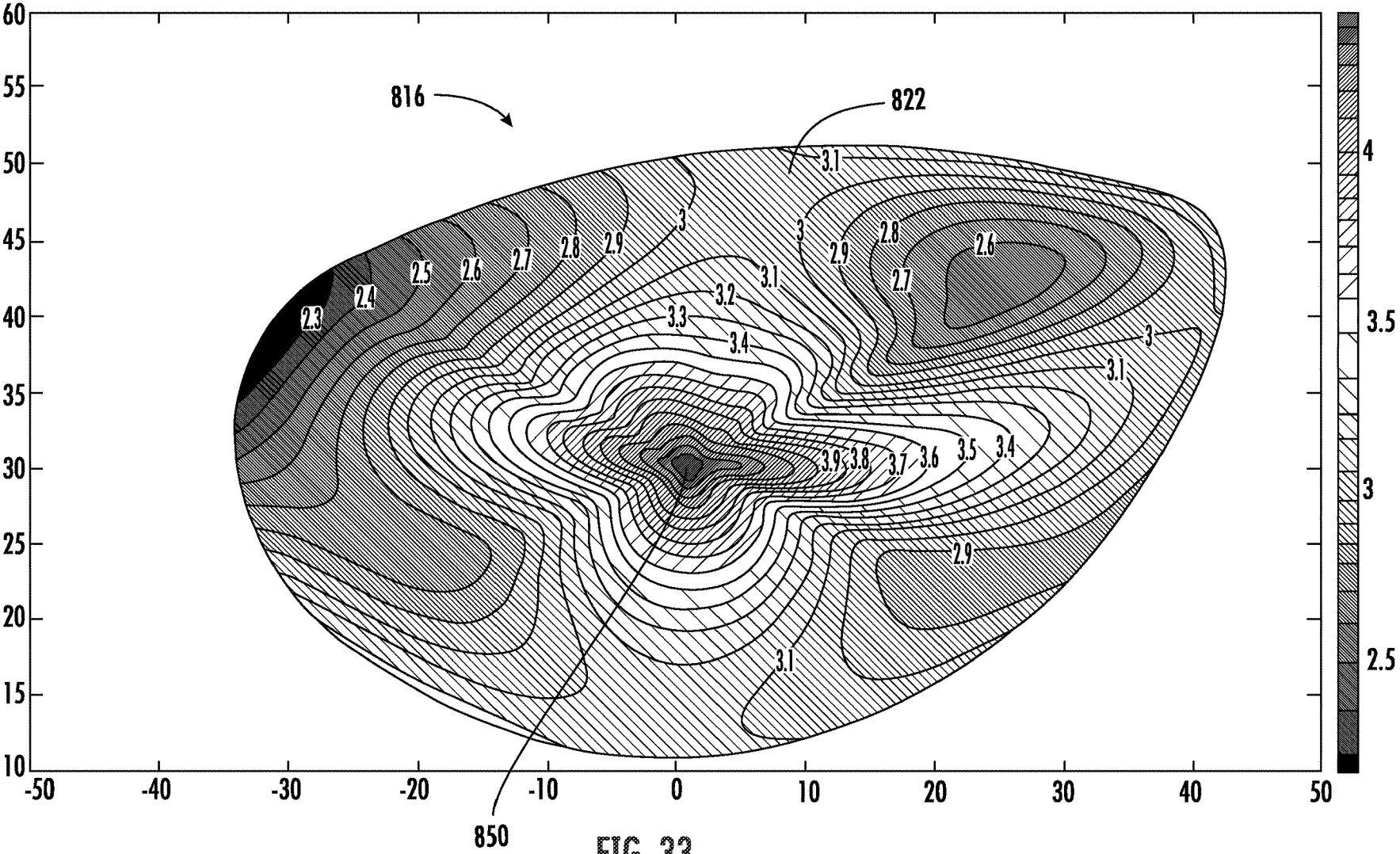
FIG. 33 is a heat map of a faceplate of an example golf club head.
Figure 34:
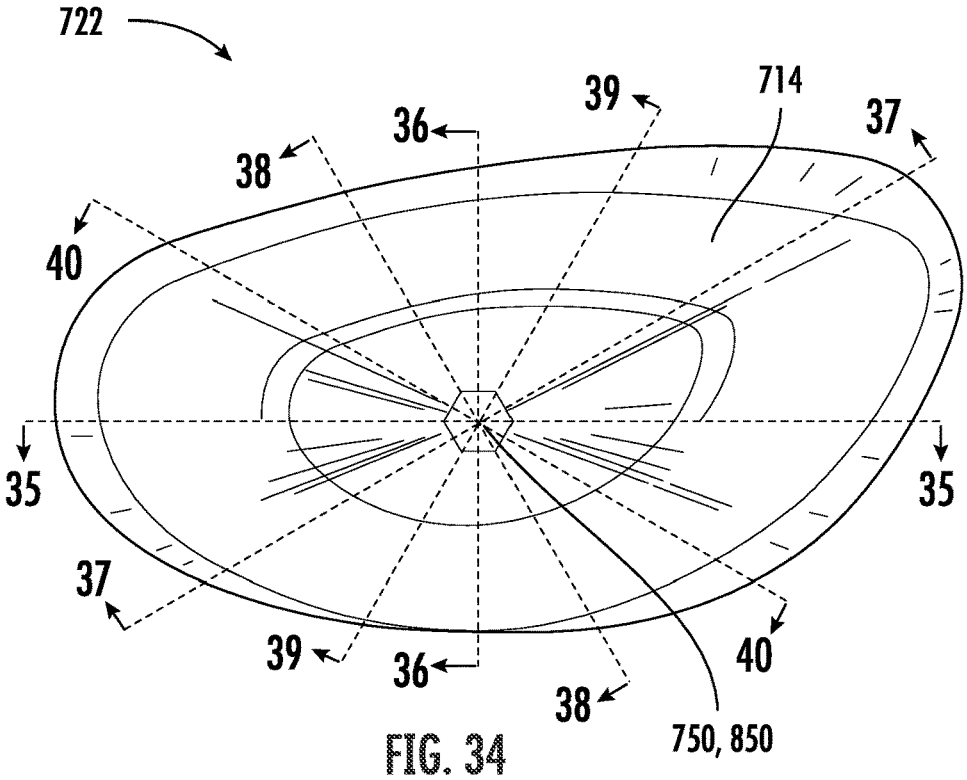
FIG. 34 is a rear view of an inner surface of a faceplate of an example golf club head of FIG. 31 illustrating example cross-sections of the example faceplate.

FIG. 33 illustrates portions of an example golf club head 816. FIG. 34 is an enlarged central location 850 of faceplate 822. FIG. 33 is a heat map illustrating the various cross-sectional thicknesses of faceplate 822. Faceplate 822 is similar to faceplate 722 except that faceplate 822 forms closed non-convex contour curves defined by the particular depicted example constant faceplate wall thicknesses. As with faceplate 722, faceplate 822 has a continuously variable wall thickness across faceplate 822 and forms a series of inter-nested closed non-convex contour curves, wherein at least two of such curves are defined by constant wall thicknesses that differ by at least 0.2 mm.

Figure 35:
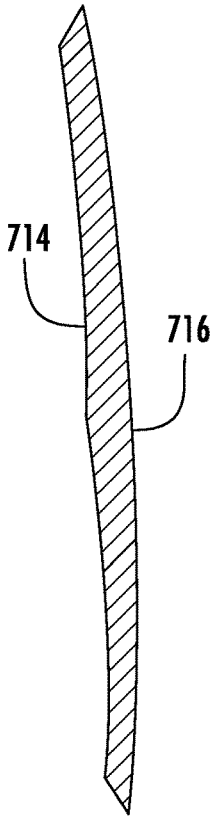
FIG. 35 is a cross-section of the example faceplate of FIG. 34 taken along line 35-35.
Figure 36:
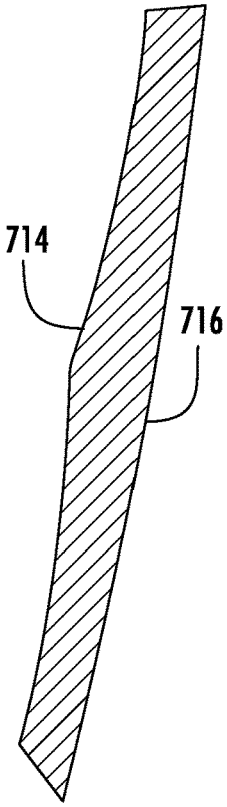
FIG. 36 is a cross-section of the example faceplate of FIG. 34 taken along line 36-36.
Figure 37:
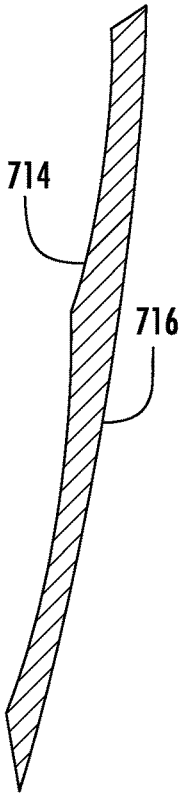
FIG. 37 is a cross-section of the example faceplate of FIG. 34 taken along line 37-37.
Figure 38:
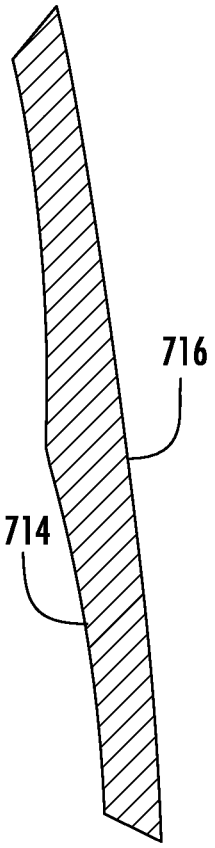
FIG. 38 is a cross-section of the example faceplate of FIG. 34 taken along line 38-38.
Figure 39:
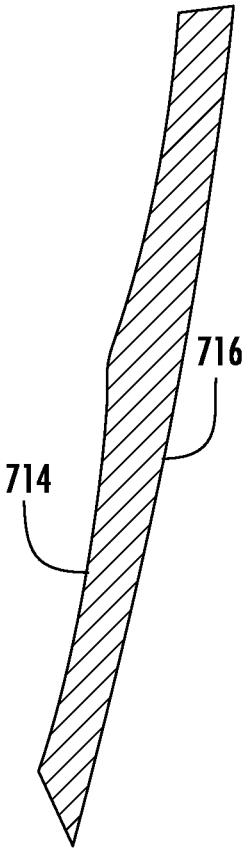
FIG. 39 is a cross-section of the example faceplate of FIG. 34 taken along line 39-39.
Figure 40:
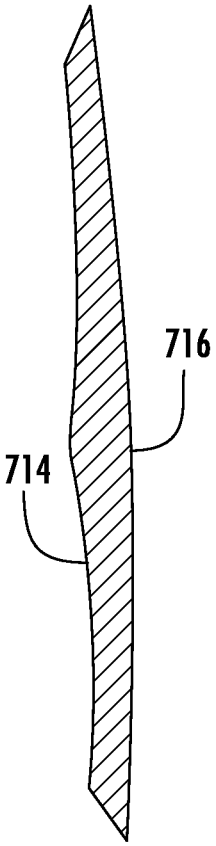
FIG. 40 is a cross-section of the example faceplate of FIG. 34 taken along line 40-40.

FIG. 34 illustrates the faceplate 722 of FIG. 31 and includes cross-section lines indicating cross-sections of faceplate 722. FIGS. 35-40 illustrate various example cross-sections through central location 750. FIG. 35 illustrates a cross-section 35-35 of FIG. 34, a cross-section that is horizontal with respect to the ground plane. FIG. 36 illustrates cross-section 36-36 of FIG. 34, a cross-section that is vertical with respect to the ground plane. FIG. 37 illustrates cross-section 37-37 of FIG. 34. a cross-section that is 30° from the horizontal cross-section 35-35. FIG. 38 illustrates cross-section 38-38, a cross-section that is 30° from the vertical cross-section 38-38 of FIG. 34. FIG. 39 illustrates cross-section 39-39, a cross-section that is 60° from the horizontal cross-section 35-35. FIG. 40 illustrates cross-section 40-40, a cross-section that is 60° from the vertical cross-section 40-40. As shown by FIGS. 35-40, each of the cross-sections undergoes a non-constant rate of change through central location 750.

Golf clubs made in accordance with the present invention are also configured for use in competitive play including tournament play by satisfying the requirements of The Rules of Golf as approved by the U.S. Golf Association and the Royal and Ancient Golf Club of St. Andrews, Scotland effective Jan. 1, 2012 ("The Rules of Golf"). Accordingly, the term "assembly is configured for organized, competitive play" refers to a golf club with a hosel adjustment assembly that fully meets the golf shaft rules and/or requirements of The Rules of Golf.

While the example embodiments of the invention have been illustrated and described, it will be appreciated that various changes can be made therein without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. One of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A golf club configured for impacting a golf ball, the golf club comprising:

a head having a body;

a faceplate coupled to the body, the faceplate having a maximum thickness at a central location the faceplate having a first closed non-convex contour curve defined by a first constant faceplate wall thickness and the first closed non-convex contour curve enclosing the central location, wherein the faceplate has no area of constant wall thickness greater than 1 $mm^2$.

2. The golf club of claim 1 further comprising a second closed non-convex contour curve defined by a second constant faceplate wall thickness and enclosing the first closed non-convex contour curve.

3. The golf club of claim 2, wherein the first constant faceplate wall thickness and the second constant faceplate wall thickness have a faceplate wall thickness difference of at least 0.2 mm.

4. The golf club of claim 3 further comprising a third constant faceplate wall thickness defining a third closed non-convex contour curve enclosing the second closed non-convex contour curve, wherein the second constant faceplate wall thickness and the third constant faceplate wall thickness have a faceplate wall thickness difference of at least 0.2 mm.

5. The golf club of claim 4 further comprising a fourth constant faceplate wall thickness defining a fourth closed non-convex contour curve enclosing the third closed non-convex contour curve, wherein the third constant faceplate wall thickness and the fourth constant faceplate wall thickness have a faceplate wall thickness difference of at least 0.2 mm.

6. The golf club of claim 1, wherein the central location has a greatest characteristic time of all locations of the faceplate.

7. The golf club of claim 1, wherein the central location comprises the location on the faceplate having the highest exit velocity when the golf club head is impacted by the golf ball having an incoming velocity of 95 mph.

8. The golf club of claim 1, wherein the closed non-convex contour curve has a polygonal shape.

9. The golf club of claim 1, wherein the faceplate is devoid of any projection inwardly extending into the golf club head that defines a closed curve enclosing the central location.

10. The golf club of claim 1, wherein the faceplate has a cross-section intersecting the central location, wherein the cross-section has continuously variable wall thickness across the faceplate.

11. The golf club of claim 10, wherein the cross-section having a faceplate wall thickness defining an inner surface that undergoes a non-constant rate of change of slope.

12. The golf club of claim 10, wherein the cross-section is horizontal with respect to a ground plane.

13. The golf club of claim 10, wherein the cross-section is vertical with respect to the ground plane.

14. The golf club of claim 13, wherein cross-section has a continuously variable faceplate wall thickness that undergoes a non-constant rate of change of slope through the central location.

15. The golf club of claim 10, wherein the cross-section is at an angle of 30° with respect to the ground plane.

16. The golf club of claim 10, wherein the cross-section is at an angle of 60° with respect to the ground plane.

17. The golf club of claim 10, wherein the cross-section is horizontal with respect to a ground plane, wherein cross-section has a continuously variable faceplate wall thickness that undergoes a non-constant rate of change through the central location.

18. The golf club of claim 1, wherein the faceplate includes a first annular region encircling the central location, wherein the first annular region is defined by an inner circle having a first radius from the central location and a second circle having a second radius from the central location, wherein the second radius is larger than the first radius, and wherein the faceplate omits any convex contour curve within the first annular region.

19. The golf club of claim 18, wherein the first radius is within the range of 0.25 mm to 3.0 mm, and wherein the second radius is within the range of 15.0 mm to 30 mm.

20. The golf club of claim 1, wherein the faceplate includes a second annular region encircling the central location, wherein the second annular region is defined by an inner circle having a first radius from the central location and a third circle having a third radius from the central location, wherein the third radius is larger than the second radius, and wherein the faceplate omits any convex contour curve within the first annular region.

21. The golf club of claim 20, wherein the first radius is within the range of 0.25 mm to 3.0 mm, and wherein the second radius is within the range of 6.0 mm to 18.0 mm.

22. A golf club configured for impacting a golf ball, the golf club comprising:

a head having a body;

a faceplate coupled to the body, the faceplate having a maximum thickness at a central location the faceplate having a first closed non-convex contour curve defined by a first constant faceplate wall thickness and the first closed non-convex contour curve enclosing the central location;

a second closed non-convex contour curve defined by a second constant faceplate wall thickness and enclosing the first closed non-convex contour curve; and a third constant faceplate wall thickness defining a third closed non-convex contour curve enclosing the second closed non-convex contour curve, wherein the first constant faceplate wall thickness and the second constant faceplate wall thickness have a first faceplate wall thickness difference of at least 0.2 mm, and wherein the second constant faceplate wall thickness and the third constant faceplate wall thickness have a second faceplate wall thickness difference of at least 0.2 mm.

23. The golf club of claim 22 further comprising a fourth constant faceplate wall thickness defining a fourth closed non-convex contour curve enclosing the third closed non-convex contour curve, wherein the third constant faceplate wall thickness and the fourth constant faceplate wall thickness have a faceplate wall thickness difference of at least 0.2 mm.

24. A golf club configured for impacting a golf ball, the golf club comprising:

a head having a body;

a faceplate coupled to the body, the faceplate having a maximum thickness at a central location the faceplate having a first closed non-convex contour curve defined by a first constant faceplate wall thickness and the first closed non-convex contour curve enclosing the central location, wherein the faceplate includes a first annular region encircling the central location, wherein the first annular region is defined by an inner circle having a first radius from the central location and a second circle having a second radius from the central location, wherein the second radius is larger than the first radius, wherein the faceplate omits any convex contour curve within the first annular region, wherein the first radius is within the range of 0.25 mm to 3.0 mm, and wherein the second radius is within the range of 15.0 mm to 30 mm.

* * * * *